United States Patent [19]

Anderson et al.

[11] Patent Number: 4,846,273

[45] Date of Patent: Jul. 11, 1989

[54] JAR MECHANISM ACCELERATOR

[76] Inventors: Edwin A. Anderson, 1104 Chimney Rock, Houston, Tex. 77056; Derrel D. Webb, 1939 Mosa Creek Ct., Houston, Tex. 77017

[21] Appl. No.: 99,350

[22] Filed: Sep. 21, 1987

[51] Int. Cl.[4] ..... E21B 31/107

[52] U.S. Cl. ..... 166/178; 175/297; 175/299; 175/300; 175/321

[58] Field of Search ..... 175/299, 297, 296, 300, 175/321; 166/178

[56] References Cited

U.S. PATENT DOCUMENTS

| | | | |
|---|---|---|---|
| 2,953,352 | 9/1960 | Webb | 255/28 |
| 3,353,613 | 11/1967 | Harrison | 175/293 |
| 3,406,770 | 10/1968 | Arterbury et al. | 175/299 |
| 3,472,326 | 10/1969 | Sutliff et al. | 175/299 |
| 3,539,026 | 11/1970 | Sutliff et al. | 175/299 |
| 3,570,612 | 3/1971 | Slator | 175/297 |
| 3,606,297 | 9/1971 | Webb | 267/125 |
| 3,735,828 | 5/1973 | Berryman | 175/299 |
| 3,834,472 | 9/1974 | Perkins | 175/296 X |
| 4,109,736 | 8/1978 | Webb et al. | 175/297 |
| 4,226,289 | 10/1980 | Webb et al. | 175/297 |
| 4,434,863 | 3/1984 | Garrett | 175/297 X |
| 4,545,444 | 10/1985 | Webb et al. | 175/296 |

*Primary Examiner*—Hoang C. Dang

*Attorney, Agent, or Firm*—Jack W. Hayden

[57] ABSTRACT

An energy accumulator for use with a well pipe string to enhance the jarring impact delivered to an object stuck in a well bore by an up and/or down jar mechanism includes inner and outer telescopically connected members relatively movable longitudinally to accumulate energy in a mechanical spring arrangement, gas or compressible liquid in the accumulator. Cooperating surfaces on the inner and outer members of the energy accumulator assure that the jarring impact of the jar mechanism members is delivered to the stuck independently of the tensile or compressive load applied to the object jar mechanism and independently of the load rate of accumulating energy in the energy accumulator.

48 Claims, 5 Drawing Sheets

JAR MECHANISM ACCELERATOR

STATEMENT OF THE PRIOR ART

Webb U.S. Pat. Nos. 2,953,352; 3,606,297; and 4,545,444; Sutliff, et al. U.S. Pat. No. 3,472,326; Harrison U.S. Pat. No. 3,353,613; and Slater U.S. Pat. No. 3,570,612 all relate to accelerators or energy accumulators to accumulate tensile energy during the up stroke of an up jar mechanism to assist in providing an enhanced jarring blow by the jar mechanism by increasing the velocity of the jarring weight located in the well string below the energy accumulator and above the impact jar mechanism.

Typically, prior art impact jar mechanisms are connected to the lower end of well pipe strings, called "fishing strings." The jar mechanisms include inner and outer members which are restrictedly movable relatively longitudinally to build up a tension load or pull force in the well string or a compressive load or push force in the well string and then to release the jar mechanism members for unrestrained, free relative longitudinal movement to engage jarring surfaces on the jar mechanism and deliver a jarring impact to a well pipe string stuck portion in the well bore.

Preferably drill collars, which are weighted tubular members, or heavy wall drill pipe is connected to the upper end of one of the jar mechanism members and functions as a hammer to assist in increasing the jarring impact delivered to the well string stuck portion below the jar mechanism. The other member of the jar mechanism is connected to the stuck object in the well bore. It is desired that the jarring impact be delivered to the stuck object to attempt to free it.

An accelerator, or energy accumulator has inner and outer members telescopically connected which are movable longitudinally. One of the members is connected to the upper end of the hammer arrangement and the upper end of the other accelerator member is connected to a well pipe string and lowered into the well bore and the jar mechanism is connected or engaged to the well pipe string stuck portion, or object, in a manner well known in the art.

So far as known to applicants, prior art up accelerators have never had any provision for a free stroke, that is, there has not been any unrestrained, free longitudinal movement of one of the accelerator members relative to the other, prior to initiating the load stroke. The total accelerator stroke in such prior art devices is merely the load stroke. In a jar mechanism, the load stroke precedes the free stroke, with the free stroke being the unrestrained, free longitudinal movement of one of the jar mechanism members relative to the other to provide the jarring impact. It is desired that the jarring impact be delivered in the jar so as to be most effective in application of the impact to the stuck portion in the well bore. Impact energy is delivered to the stuck object in a magnitude of the product of the mass of the weight of the drill collars, or heavy wall pipe, and its velocity squared.

Single acting up accelerators of the prior art employed with single acting up jar mechanisms, operate on the theory that the load stroke of the accelerator is always greater than the free stroke of the up jar mechanism.

In many cases of severely crooked well bores or where surface operating equipment is insufficient, there may not be enough load transmitted to the accelerator to assure that the total stroke of the accelerator is greater than the impact jar stroke.

If, because of the above or any other reason, the accelerator stroke is shorted than the unrestrained, free longitudinal movement of the jar mechanism member, the drill collars, or "hammer", will act to move the accelerator members relatively to cause their surfaces to engage and apply an impact within the accelerator which impact is transmitted to the well pipe string above the accelerator and not to the stuck object. In such event, the accelerator action is not only detrimental to any impact jar action to the stuck object, but jarring blows delivered to the fishing string may and do damage it.

The accelerator structures disclosed in the above patents as well as subsequent improvements known to applicants do not accommodate changes in operating conditions present in well bores such as temperature, pressure and loading, which may vary continuously. These factors may have a detrimental affect on existing energy accumulators to render them inefficient or inadequate and detrimental to the jarring action of impact jar mechanisms so that the jar does not function properly, or which may cause the jarring impact of the jar mechanism to be delivered to the well pipe string thereabove instead of to the well pipe string stuck portion beneath and connected with the jar mechanism. As noted previously, where the jarring impact of the jar mechanism is delivered to the well string instead of the stuck portion thereof, the well string may be damaged, and impacting the well string instead of the stuck portion thereof has a negating effect on actually freeing the stuck portion of the well string in the well bore.

When the energy accumulator employs compressible mediums such as a silicone liquid or nitrogen, increases in well bore temperatures and pressures greatly affect the load rate of the accelerator during the load stroke, and such changes may be so severe in deep well bores that the accelerator cannot be extended at all and thus the total stroke is zero so as to provide no free stroke before the load stroke. Even where existing accelerators extend a small amount less than the free stroke of the impact jar the resulting shorter stroke of the accelerator will recover first and deliver impact from the jar mechanism up to the well pipe string above the accelerator instead of to the stuck portion below the jar mechanism.

Double acting, that is up and down jar mechanisms, have been introduced and used for a number of years. While present accelerators and energizers are more or less efficient in enhancing the up delivery for high impact, they have no affect on accumulating energy and accelerating impact weights to effect an enhancement of a jar device designed to deliver a downward impact.

Certain frequent drilling operations necessitate the use of double acting jars when the drilling assembly becomes stuck off bottom. This condition nearly always requires the use of a downward acting jar to free the stuck members so that upward jarring may be accomplished to recover the complete drill string. Another circumstance encountered in drilling operations requiring use of downward acting jars and accelerators is in drilling deviated and high angle holes where the jarring activity is impeded due to the high angle and other forms of bore hole deviation.

So as far as known to applicants, while the foregoing patents and other existing accelerators, however, inadequate, disclose structures for enhancing the up jar mechanism, applicants are not familiar with any accelerator which can be employed with a combination up and/or down jar mechanism which overcomes the above problems encountered with accelerators presently employed.

Another circumstance of use of single acting accelerators and energizers that fail to satisfy the need described in the prior art is seen to be in failure of all single acting devices to meet alternately light to heavy load requirements. The present single acting energizers or energy accumulators are by necessity high load rate devices. That is, the displacement of the energizer must have sufficient loading capacity that its displacement will cooperate with the displacement of the impact jar which is to be enhanced. Sufficient and correct load rates are difficult to obtain when utilizing springs, dish washers, hoop stress rings or the like for energy storage means, even when compounding such means as disclosed in the Sutliff U.S. Pat. No. 3,472,326. Accordingly, sufficient and correct displacement rates are difficult to obtain that will satisfy light and/or heavy impact loads by using relatively low compressible fluids, even when providing extra large volumes for such energy storage means. Utilization of a gas as the energy storage provides acceptable load rates and displacements, but is highly sensitive to subsurface temperature changes. The actual defects of all the present single action energizers mentioned above is in the fact that in light jar load requirements the state of the art energizers do not have sufficient displacement flexibility to power the available jar devices. If the load displacement of the energizer is insufficient, in lighter load applications, the displacement of the energizer may recover first after the impact jar releases. When this happens, all the kinetic energy of the weight accelerated by the energizer is delivered in impact to the energizer, as it closes first, and no impact whatsoever is delivered to the stuck object by the impact jar. The result is that a jar blow is delivered to the fishing string and no jar impact can be transmitted to the stuck point. Evidence of this is frequently demonstrated by damage to the fishing string just above the fluid and mechanical type energizers. Gas-type energizers can also duplicate this undesirable flaw if the high bottom hole temperature is not accounted for. The deception of this flaw is that there may be strong surface indication of impact delivery when in fact no impact at all is delivered to the stuck object within the well bore.

The load rate of accelerators, because of the subsurface well bore temperature and pressure, may be so seriously altered that the devices overload when a load is applied to the well pipe string to effect a jarring impact by the jar mechanism to the well string stuck portion. Such overloading may cause a rupture load to be imparted to the accelerator before its stroke limit is reached.

Another problem with existing accelerators which employ compressible mediums is that the compressible medium must be isolated in a chamber in an attempt to avoid or lessen the load rate affect thereon due to well bore conditions. However, the compressible medium chamber walls become subject to the extremes of subsurface conditions, such as hydrostatic pressure so that the piston system of the accelerator may become subject to erratic movement within the accelerator because of low internal and high external pressures. The piston system may even become restricted during its stroke due to encroachment or flexing of the chamber wall by reason of well bore conditions which may in turn may affect the load rate of the accelerator and even completely prevent proper movement of the accelerator through its load stroke.

SUMMARY OF THE PRESENT INVENTION

An object of the present invention is to provide an accelerator with a free stroke prior to the load stroke.

An object of the present invention is to provide an accelerator, or energy accumulator for use with a combination up and/or down jar mechanism which overcomes the above and other disadvantages found in present accelerators.

Another object is to incorporate a double acting up or down accelerator in a single tool to accelerate jarring weights located above double acting jarring mechanisms to higher energy levels for use in highly deviated well bores.

Yet another object of the present invention is to provide an accelerator for use with a jar mechanism which is constructed and arranged to assure that the jarring impact is delivered to the stuck object instead of to the well pipe string.

Yet another object of the present invention is to provide an accelerator or energy accumulator for use with a jar mechanism which not only assures that the jar mechanism impact is delivered to the stuck object, but which functions independently of the load rate of energy accumulation in the accelerator or energy accumulator.

Yet a further object of the present invention is to provide an accelerator for use with a jar mechanism which provides a free stroke in the accelerator which is always greater than the free stroke of the impact jar mechanism so that the accelerator or energy accumulator may function independently of its load rate to deliver a jarring impact to the well string stuck portion.

Another object of the present invention is to provide a double acting accelerator that in operating with a free stroke provided between the limits of maximum up and down loads will essentially eliminate the possibility of impact occurring within the energizer itself and thus make it more adaptive to the better types of hydraulic double acting jars that have wide load range capability. By the same measure of novelty, this double acting device will vastly improve the impact delivery of all single acting fishing jars, especially those jars which have very light to heavy loading capability.

A further object of the present invention that is applicable where previous single acting devices fail is in supplying down energy to the jar system without damage to the well pipe string on which the jar system is run. When down jarring, the weight due to gravity on weight elements concentrated just above the jars has heretofore been the only energy source available with which to jar down. With previous accelerators or energy accumulators that are effective only in the up direction, when activated by energy supplied by surface pull, there is no accumulating, storing, and subsequent release of the gravity generated energy to deliver a like impact blow in the down direction. To place excessive weight down on impact tools in the down direction causes buckling and destructive forces to come on the well pipe string members above the jar.

A further object of the present invention is seen to be a second reservoir of energy to be effective on the down jar, and further novelty is seen in the ability to use considerable portion of the string above the accelerator without danger of buckling or damaging that portion of the fishing string thus used.

Still a further object of the present invention is in utilizing multiple or compounded storage chambers to store and accumulate energy for jarring activities both in the up and down direction.

Another object of the present invention is in its ability to provide acceptable energy storage capacity to power single or double acting jars, but be able to have overload features that will prevent overloading the system when "working" the pipe or fish string above the load capacity of the energizer.

Yet another object of the present invention is in the shock absorbing ability of the energizer after delivering the necessary energy to the jar mechanism. This feature confines the impact blow generated by the energy accumulated to the immediate area of need and away from members of the well pipe string that are used to support the impact system.

A further object of the present invention is to provide a overload safety compensator for use with compressible fluid accelerators to inhibit overloading and possible damage to the accelerator where the load rate is drastically changed by well bore conditions.

Still another object of the present invention is to provide a seal arrangement to isolate and build up energy within a compressible fluid in an accelerator, which seal arrangement is constructed and arranged to accommodate reduction in size of the bore through which its moves due to well bore pressure on the walls of the accelerator in which such bore is provided.

Yet a futher object of the present invention is to provide a spacial arrangement in an accelerator or energy accumulator so that all the input energy in the accelerator is recovered on the impact stroke of the jar mechanism with which it is employed and to assure that the jarring impact is delivered to the well pipe string stuck portion and not to the well pipe string above the accelerator.

A further object is to provide a method of forming a spacial arrangement in a double acting up and down accelerator to inhibit interference by the accelerator with operating the jar mechanism in a well pipe string to deliver a jarring impact to a stuck object in a well bore.

A further object is to provide a method and apparatus to assure that a jarring impact, either up or down, enhanced by an energy accumulator is delivered to a stuck object in a well bore and functions independently of well bore conditions.

DESCRIPTION OF THE PREFERRED EMBODIMENTS

The present invention will be described wherein the "object" stuck in the well bore B may be originally part of the well pipe string S and becomes stuck in the well bore, or it may be an object stuck in the well bore and a "fishing string" or well pipe string S with the energy accumulator E of the present invention, weighted members 30, such as drill collars and a jar mechanism J of any suitable type, lowered into the well bore and the jar mechanism J engaged with the stuck object.

When the stuck object becomes connected with the jar mechanism, it becomes part of the well pipe string S and it also is referred to herein as the well pipe string stuck portion.

Figure 1:
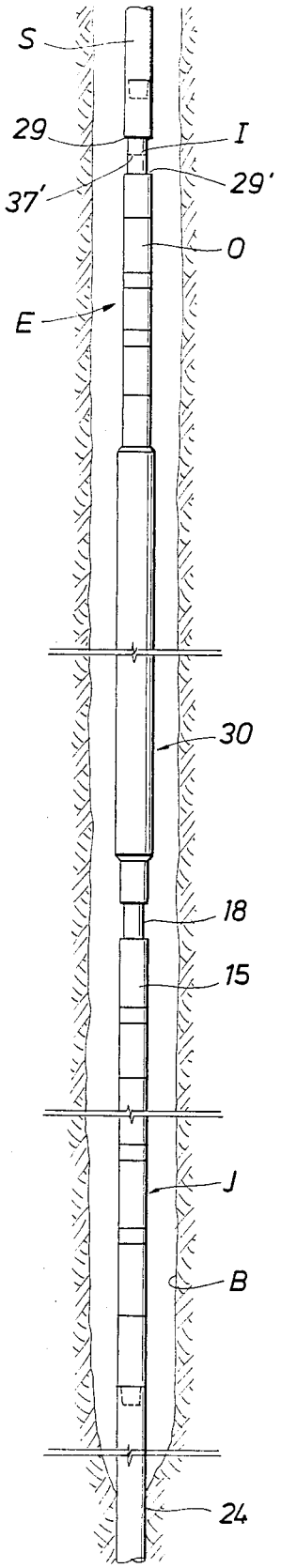
FIG. 1 is a schematic view illustrating a typical jar system arrangement and illustrating a preferred relationship of the present invention to the well pipe "fishing" string, the weighted "hammer" and a form of jar mechanism in a well bore and wherein the jar mechanism is connected with a stuck portion object.
Figure 2:
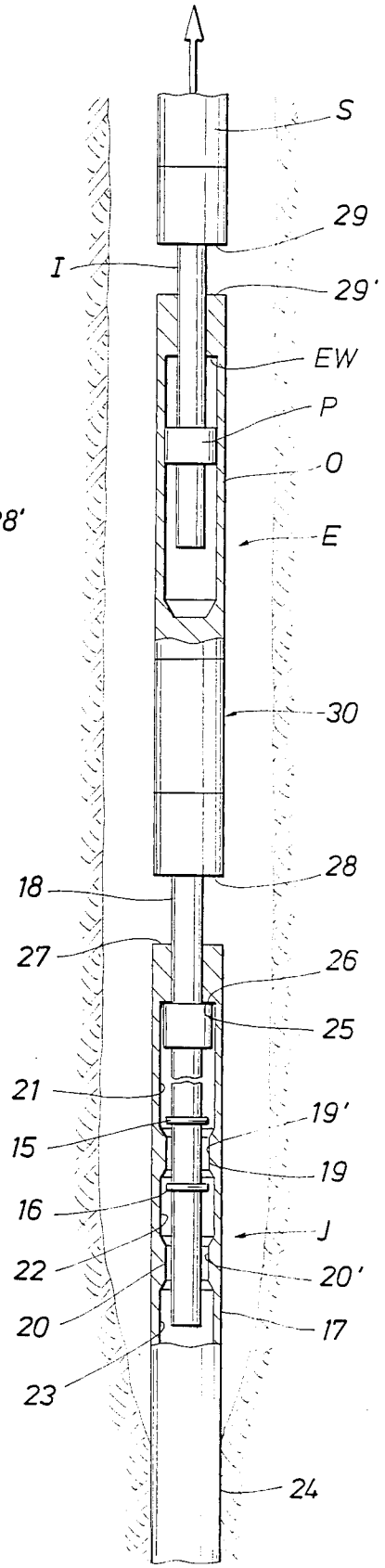
FIG. 2 is a schematic illustration of a well pipe string, an accelerator secured therewith and depending therefrom, with one form of a jar mechanism secured to drill collars, or the like, at its upper end and to the stuck portion of the well pipe string at its lower end.

Attention is first directed to FIGS. 1 and 2 of the drawings wherein the jar mechanism represented generally by the letter J includes an outer tubular member 17 in which extends longitudinally an inner member 18. The inner tubular member 18 is movable longitudinally relative to the outer member 17 in response to a tensile or compressive load in the well pipe string to build up energy therein and in the accelerator for delivering a jarring impact to the stuck portion of the well string represented at 24. The inner member 18 is connected at its upper end to the drill collar portion 30 of the well string, which forms the hammer when the jarring mechanism J is actuated for delivering a jarring impact to the well pipe stuck portion 24. The drill collar portion 30 is of suitable extent to perform its function.

The upper end of the drill collar portion 30 is connected to the lower end of the outer member O of the energy accumulator represented generally by the E as shown in the drawings, and the energy accumulator E includes an inner member I which is telescopically received within the outer member O as schematically illustrated in FIG. 2 and it is connected at its upper end to the well pipe string S.

The jar J may be, preferably, a double acting up or down jar or a single acting jar, which for practical purposes is generally an up jar. Any type of jar may be employed with the present invention.

The jar J of FIG. 2 schematically illustrates one form of a double acting up and down hydraulic means jar, but a mechanical means actuation could also be employed.

In a hydraulic jar, the inner member 18 is provided with longitudinally spaced piston means 15, 16 and longitudinally spaced longitudinally extending restriction means 19 and 20 forming longitudinally spaced bores 19', 20' of smaller diameter than adjacent longitudinally extending bores 21, 22, and 23. The structure and operation of such device is well known and one form is shown in Webb, et al. U.S. Pat. No. 4,109,736.

The jar J in FIG. 2 is shown at the moment of delivering an up jar impact within the jar mechanism in the intended and preferred manner to accelerate the drill collars, or hammer portion 30 of the well string S to deliver a jarring impact to the well pipe stuck portion 24 in an endeavor to free it.

To build up energy in the well pipe string and accelerator to deliver an upward impact, the piston means 15 is positioned beneath restricted bore 19 and a tensile load applied at the earth's surface to the well string S to move piston 15 into and through the restricted bore 19'. This is referred to as the load stroke of the jar and when the piston 15 reaches the upper end of the restricted bore 19' and moves into enlarged bore 21, the inner member 18 is released for unrestrained, free longitudinal movement relative to outer member 17 to engage jarring surfaces 25 and 26 in the jar and deliver a jarring impact. The extent or length of the free stroke is the longitudinal extent of free movement of inner member 18 when it is released from bore 19' until surfaces 25, 26 engage. At such time it is preferred that the piston P on the inner member I of the energy accumulator E, be spaced from the inner end wall EW as illustrated in FIG. 2.

The jar functions in response to a compressive load on the well string S to move lower piston 16 into and through restricted bore 20' to build up energy and then release the piston for unrestrained, free movement of inner member 18 to engage surfaces 27, 28 in the jar J to deliver a downward jarring impact. The distance of the free downward movement of the inner jar member is from its release from restricted bore 20' until surfaces 27, 28 impact. This free distance, up and down, is predetermined by the jar construction, and is a fixed, known distance in each jar and varies depending upon the amount of unrestrained, free longitudinal movement in the jar.

Figure 3:
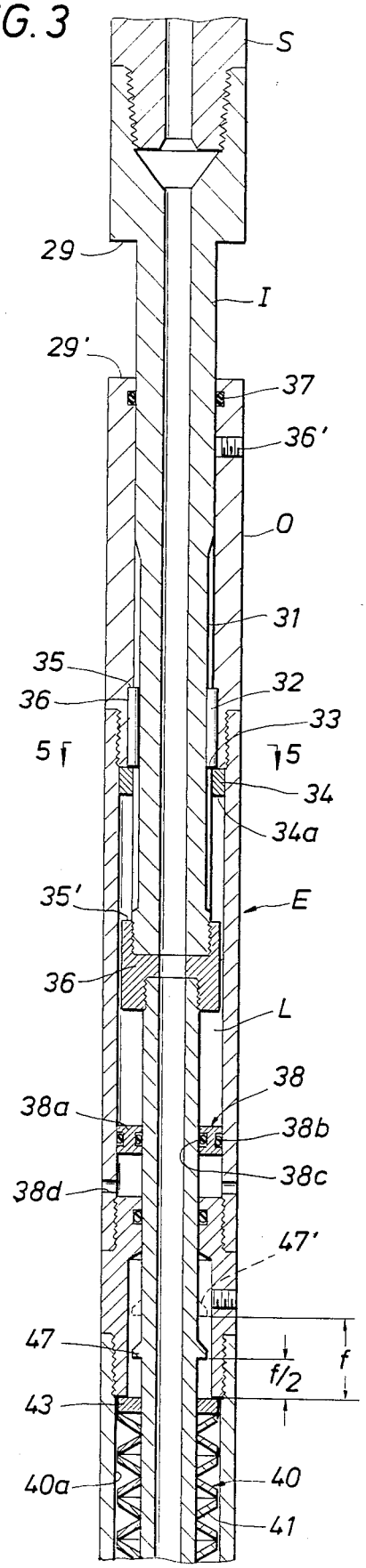
FIGS. 3 and 4 are sectional views which, when taken together, illustrate one embodiment of the present invention.
Figure 4:
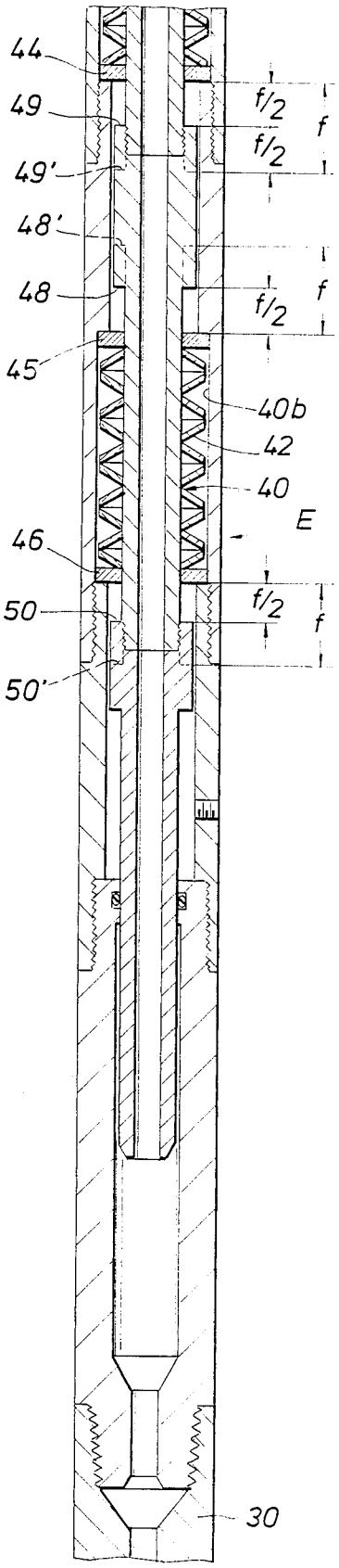
Figure 6:
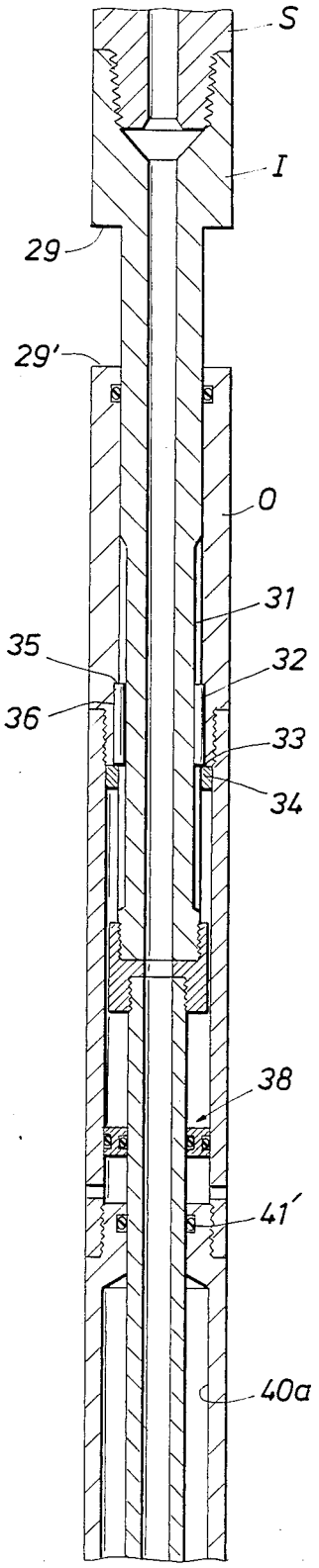
FIGS. 6 and 7 are sectional views which, when taken together, illustrate another embodiment of the present invention which may be employed with a compressible medium such as gas.

In FIGS. 3 and 4 one embodiment of the energy accumulator of the present invention is illustrated with FIG. 3 illustrating the upper portion of the energy accumulator E and FIG. 4 being a continuation demonstrating the lower portion whose lower end is connected to the drill collars 30 in the well pipe string S. The inner member I is shown at its upper end as connected to the well pipe string S whereby a tensile and/or compressive load may be selectively supplied through the well string to the jar mechanism J and to the energy accumulator E of the present invention for building up energy in the well pipe string and accelerator.

The inner member I and outer member O are shown in the drawings as comprising a plurality of longitudinally extending sections which are secured together by any suitable means such as threads or the like, and if necessary suitable seal means may be employed to assure fluid integrity of each.

Figure 5:
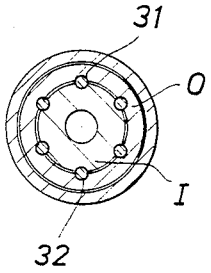
FIG. 5 is a sectional view of the line 5–5 of FIG. 3 illustrating further structural details.

The inner member I includes a plurality of circumferentially spaced longitudinally extending grooves 31 in which are received drive pins or members 32 which are secured or positioned on the outer member in any suitable manner. As shown the lower end 33 of the members 32 rests on the annular ring 34 and their upper ends 35 abut the end of the groove 36 in which such pins 32 are received in the outer member O. The ring is mounted in a groove in outer member O as illustrated in the drawings. The members 32 are circumferentially spaced as illustrated more clearly in FIG. 5 of the drawings about the outer member O and this arrangement accommodates relative longitudinal movement between the inner members I and O while inhibiting relative rotation therebetween.

Suitable seal means 37 and 38 are provided which form a lubricating chamber L for providing lubricant to the drive members 32 when desired. Suitable fill plug means 36' is provided for enabling a lubricant supply to be provided between the inner members I and the outer members O.

As illustrated the seal means 38 includes the annular ring **38*a* which is provided with seals 38*b* and 38*c* for engaging the inner wall of the outer member O and outer wall of the inner member I, respectively. A port 38*d* is provided for communicating well bore fluid to act on the floating seal arrangement 38** to equalize pressure in the lubricating chamber L with the pressure in the well bore.

Any suitable form of spring means may be employed with the form of energy accumulator of the present invention illustrated in FIGS. 3 and 4. Mechanical spring means are illustrated in the form of Belleville washers, or mechanical spring means referred to generally by the numeral 40. As illustrated two of such mechanical spring means 41 and 42 are provided for accumulating energy in response to either a tensile or compressive load in the well string S for cooperating with the jar J to enhance the jar impact upon release of the jar for free unrestrained movement between its members 17 and 18 to deliver a jarring impact to the well string stuck portion 24 as will be described in greater detail. It will be noted that the mechanical spring means 41 is arranged in a first chamber **40*a* and the second mechanical spring means 42 is arranged in a chamber 40*b* as shown in the drawings. Any suitable combination of spring and chamber arrangement may be employed to accomplish the desired results. The mechanical spring 41 is abutted against the annular movable support ring or member 43 at its upper end and the annular movable ring member 44 at its lower end and the mechanical spring 42 is supported adjacent its upper end on the annular movable support member or ring 45 and at its lower end on the annular movable support member or ring 46**.

Suitable surface means are provided on the inner member I to engage the movable support members or rings in the chambers **40*a* and 40*b* to compress the spring means 41 and 42** in response to a tensile load or compressive load on the well string to build up energy therein for release when the jar mechanism releases to deliver a jarring impact, so as to enhance the jarring impact delivered by the jar mechanism in either an up or down direction as desired.

More importantly, the arrangement and spacial relationship of the surface means on the inner member I and the support members in the chambers **40*a*, 40*b* is such that the jarring impact of the jar J is controlled for delivery to the jarring surfaces in the jar J to accelerate the drill collars 30 and thereby assure that the jarring impact is delivered to the well pipe string stuck portion 24 instead of to the well string above the energy accumulator E or being dissipated in the accumulator E. As previously noted, where the jarring impact is delivered to the well pipe string above the energy accumulator E instead of the stuck portion, substantially damage may occur to the well pipe string by reason of such hammer blow. Further, such impact to the well pipe string above the energy accumulator generally has little if any effect at all in releasing the well pipe stuck portion 24**.

As noted previously, the jar mechanism members are constructed to restrict relative longitudinal movement therebetween to build up energy in the well pipe string and accelerator and then to release one of the jar mechanism members for unrestrained, free longitudinal movement relative to the other member to engage the jar mechanism jarring surfaces for delivering a jarring impact to the well pipe string stuck portion in either an upward or downward direction. The energy is built up in the accelerator E due to either a tensile or compressive load in the well string S.

Where the load rate of the accelerator E is changed due to temperature and/or pressure conditions in the well bore, such change may be so severe that an accelerator cannot be extended at all in response to either a load or force applied to the well string, particularly where the spring medium is a compressible fluid such as nitrogen or silicone liquid. In this event, the total stroke of the accumulator, or total relative movement between the inner member I and outer member O may be very small or even zero. If the accelerator does not extend relatively more than the unrestrained, free longitudinal stroke between the jar mechanism members, on either an up jar motion or on a down jar motion the shorter stroke of the accelerator will recover first when the jar mechanism is released to deliver an impact motion, either up or down, but such impact will be delivered by the jar mechanism to the drill collars 30 and up to the accumulator E to impact its opposed surfaces on inner member I and outer member O, which impact is delivered to the well pipe string S connected to the accelerator.

For example, on an up jar motion, if the unrestrained, free longitudinal stroke of the accelerator is not greater than the unrestrained, free longitudinal stroke of the jar members, then the accelerator surface 29' moves up and hits surface 29 so that the upward impact is delivered to the well pipe string S above the accelerator and not to the stuck portion 24 below the jar J.

Similarly, on a down jar motion, if the unrestrained, free longitudinal stroke of the accelerator is less than the unrestrained, free longitudinal stroke of the jar members, then the accelerator surface EW moves down and engages the upper surface of piston P so that the downward impact is again delivered to the well pipe string S above the accelerator and not to the well pipe string stuck portion 24 below the jar J.

In either an up jar or down jar motion the jarring surfaces on the jar mechanism J must impact before the surfaces on the accelerator E for most effective results.

The present invention, in response to a tensile load or compressive load in the well pipe string S forms, or provides a spacial arrangement which defines a free stroke in the accelerator which is greater than the free stroke of the jar J to assure that the jarring surfaces of the jar mechanism members will engage and thereby deliver a jarring impact to the well pipe string stuck portion 24. Prior art, accelerators, even though heretofore used only with single acting up jars, may prevent engagement of the jar impact surfaces, in which event the jar force is delivered to the accelerator E to move it up and impact against the lower end of the well pipe string S. This nullifies the intended function of the jar J.

It can be appreciated that the inner member I and outer member O and the surfaces formed thereon to provide the unrestrained, free relative longitudinal movement between the inner and outer members will be structured during manufacture and assembly to develop the unrestrained, free relative longitudinal movement therebetween in accordance with this invention as will be described.

Without limitation, and by way of example only, it is desirable that the longitudinal extent between the downwardly facing surface 29 on the inner member I and the upward facing surface 29' on the outer member O preferably approximately 25 inches. The limit of relative longitudinal upward movement of the inner member I to the outer member O is limited to the longitudinal extent between the surface end 35' on the annular enlargement 36 and the surface **34*a* on ring member 34. Relative downward longitudinal movement between the inner member I and outer member O is limited by engagement of surface 29 with the opposed surface 29'**.

Figure 1A:
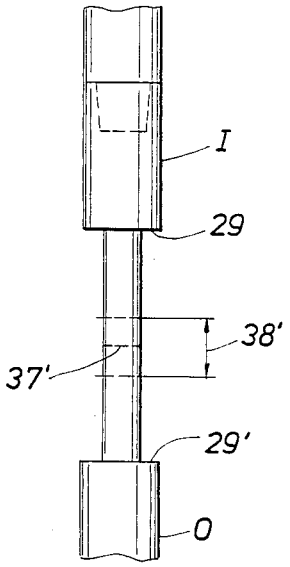
FIG. 1A is an enlargement of a portion of FIG. 1 to better illustrate the physical relationship of the energy accumulator components.

The zero load position, that is where no load is placed on either the energy accumulator E or the jar J by the well string S, is represented by the line 37' in FIG. 1A. The minimum unrestrained, free longitudinal relative movement between the inner member I and outer member O is represented by the distance 38' extending equally above and below the zero load position 37', an equal amount in both the upward and downward direction. The maximum up load position is represented in FIG. 1 which occurs when the inner member I is extended to its full limit so that surfaces **34*a* and 35', shown in FIG. 3, engage. The maximum download position occurs when surfaces 29 and 29'** engage.

Applicants believe that the preferable minimum free stroke of a jar component to attain the best jarring impact is about eight inches, but others may prefer a different free jar stroke. If it is assumed, for purposes of explanation, that the free jar stroke is eight inches, then the total distance or length represented at 38' is a minimum of, and preferably somewhat greater, eight inches, that is, four inches up from line 37' and four inches down from line 37'. Similarly, in the present invention, this would dictate that the free stroke of the accelerator in either an up jar or down jar situation would be a minimum of, and preferably some longer than eight inches to assure that the beneficial results of this invention are attained.

FIG. 1A illustrates that zero load position is midway of the twenty-five inch spread between the inner and outer energy accumulator members I and O when fully extended in the maximum up load position so as to accomodate the load stroke and free stroke of the double acting jar mechanism. The twenty-five inch spread may vary.

In actual operation of the tool the displacement longitudinally between the inner member I and outer member O constituting unrestrained, free longitudinal movement or the free stroke between members I and O represented by the distance 38' will normally be in the range of approximately eight inches, and may be more. The foregoing displacement is by way of example only and is not intended as a limitation.

The inner member I in the double acting accelerator of the present invention is provided with radially projecting, annularly extending surface means 47 which is longitudinally spaced relative to the movable support member 43 at the upper end of mechanical spring means 41 and is also provided with radially, annularly extending surface means 48 which is longitudinally spaced from the movable support 45 at the top of mechanical spring means 42 in the top of the chamber 40*b*.

The inner member I in the double acting accelerator of the present invention is further provided with radially projecting annular surface means 49 which is longitudinally spaced relative to the movable support member 44 at the bottom of spring 41 in chamber 40*a* and is also provided with radially and annularly extending surface means 50 which is longitudinally spaced relative to the support member 46 at the bottom of spring member 42 in chamber 40*b* as shown in FIGS. 3 and 4 of the drawings. The minimum longitudinal extent or distance between each of the radially projecting surfaces 47, 48, 49 and 50 and their respective adjacent movable members 43, 45, 44 and 46, is at least, and preferably somewhat longer than a minimum of one half of the unrestrained, free longitudinal movement of the inner member 18 in the outer member 17 of the jar mechanism before compressive loading of the spring means 41 and 42 commences in the energy accumulator in response to a tensile or compressive load in the well string S. This enables the energy accumulator to operate in the well bore so that the total of unrestrained, free longitudinal movement of its inner member I relative to the outer member O during operation of the assembly in the well bore, in response to a tensile load, will be the longitudinal extent between the surface 47 and movable member 43, as well as the longitudinal extent between surface 48 and member 45 when a tensile load is applied by the well string to build up energy in the accelerator and move piston 15 through restricted bore 19' to release it so that the jar mechanism inner member is unrestrained and can move freely for delivering an upward jar. This distance is shown by the letter "f" in FIGS. 3 and 4 where 47 and 48 have been moved up with I of the energy accumulator as energy is built up in the accelerator and are represented in dotted line at 47' and 48' at the relative position they assume in response to tensile loading on well string S to release jar member 18 for unrestrained free upward travel. When a compressive load is applied to the well string the total unrestrained, free longitudinal movement of the inner member I is the longitudinal extent between surface 49 and member 44, as well as the longitudinal extent between surface 50 and member 46, which is also represented by f/2. The unrestrained, free longitudinal movement of the inner jar member 18 is the distance it travels when piston 16 clears restricted bore 20', until surfaces 27 and 28 impact.

While the invention is described with reference to the hydraulic medium jar J represented schematically in FIG. 2, the function of the invention is the same where a mechanical jar is employed.

The distance between 47' and 43 and the distance between 48' and 45 are each at least a minimum predetermined length which is greater than the unrestrained, free relative longitudinal movement between the inner and outer jar members 17, 18 to enable jarring surfaces 25, 26 to engage and deliver a downward jarring impact.

In other words, during operation of the mechanism in the well bore B when a tensile load is applied to the inner member I by the well string S to build up energy in the well pipe string and accelerator for thereafter delivering a jarring impact, the surface 49 and surface 50, FIG. 4, each move, as represented by f/2, a minimum of one half of the total unrestrained, free relative longitudinal movement of the inner member I before a tensile load application begins on each spring 41 and 42 by surfaces 50 and 49 engaging their respective movable members 46 and 44 to apply a tensile load to the springs 41, 42 to build up energy therein. Since the inner member I moves up one half of the total distance of the unrestrained, free longitudinal movement desired in the tool, and since radial surfaces 47, 48 are each initially, as represented by f/2, one half the distance from their respective movable members 43, 45, surfaces 47, 48 in response to the upward movement of the inner member I on the application of the tensile load each move up yet another minimum one half of the longitudinal extent of the unrestrained, free longitudinal relative movement of the inner member of the jar mechanism to the positions indicated in dotted line at 47', 48'. The minimum longitudinal extent provided by the longitudinal extent between the radial surfaces represented at 47, 48 and their adjacent movable members 43 and 45 resulting from the tensile load applied to the inner member of the accumulator E must exceed the unrestrained, free longitudinal relative movement between the inner and outer members of the jar J when the jar is released for free travel to deliver a jar blow.

When the tensile load is applied to the accumulator by the well string S, such tensile load is transmitted through the drill collars 30 and to the jar mechanism to build up energy in the accumulator by moving the inner member 18 of the jar longitudinally upward relative to the outer member 17 as previously described. When the inner member 18 of the jar J is released for free travel to engage surfaces 25, 26 and deliver a jar blow, the drill collars 30 in the well string above the jar J are moved upwardly since they are connected to inner member 18. This in turn moves the outer housing O of the energy accumulator relative to the inner member I.

If the longitudinal extent between the radial surface 47 when in position as indicated at 47' and the member 43, or the longitudinal extent between surface 48 when in the position as indicated at 48' and the movable member 45 is less than the unrestrained free longitudinal extent of the movement of the inner member 18 of the jar, to engage jarring surfaces 25 and 26 and deliver a jarring impact then the upward movement of the drill collars 30 in the well string in response to the upward movement of the jar mechanism will cause the movable members 43 and 45 to engage their respective adjacent radial surface 47, 48 when in position 47' and 48', respectively, so that the tensile load developed by the jar and intended to be delivered to the stuck portion 24 of the well bore will instead be transmitted to the accelerator and move the end surface 29' up into engagement with the surface 29 and transmit the upward jarring blow to the well string above the accumulator E and not to the stuck portion 24 thereof as desired and intended.

When a compressive load is applied to the well string to develop energy in the accelerator for assisting in delivering a downwardly directed jar to the well string stuck portion 24, the compressive load from the well string S is transmitted from the inner member I to engage surfaces 47 and 48 with their respective movable support members 43 and 45 to compress the mechanical spring means 41 and 42 in each of the chambers 40*a* and 40*b* to build energy therein. The compressive load applied to the well string is also transmitted to the jar J to build up a compressive load therein and move the piston means 16 into and through with restricted bore 20' to restrict relative longitudinal movement between members 17, 18 of the jar to build up energy in the well pipe string and accelerator for delivering a downward jar impact. When the piston 16 disengages from restrictive bore 20' the inner jar member 18 is released for unrestrained, free longitudinal downward movement relative to the outer member 17 to engage downward jarring impact surfaces 27 and 28 and deliver a downward jar to the well pipe string stuck portion 24.

When the inner member 18 of the jar J moves down in such manner, the outer housing O of the accelerator is also pulled downward since it is connected to the inner member 18 through the drill collars 30. However, the springs 41 and 42 have been compressed by downward movement of the inner member I so that the movable members 43 and 45 compress each spring 41, 42 and build up energy therein so that when the outer housing O is released, the energy in the compressed members 41, 42 is also released to further urge the outer housing O down and enhance the downward jarring impact.

From the foregoing it can be seen that the spacial relationship between the surface means on the inner member and outer member is such that a minimum predetermined length of unrestrained free, relative longitudinal movement is provided between the energy accumulator inner and outer members in response to either a tensile load or a compressive load on the well pipe string. As shown in FIGS. 3 and 4, the spacial distance is formed by the configuration and arrangement of the surface means 47, 49, 48 and 50 on the inner member and the arrangement and positioning of the movable support members 43, 44, 45 and 46 which are carried on and supported by shoulder means in the outer member.

The configuration and arrangement of the surfaces on the inner member I and outer member O of the accelerator E assure that in a double acting up and down jar, as well as in a single acting jar, the jar impact surfaces in an up jar or the jar impact surfaces in the down jar will impact before the accelerator surfaces, thus assuring that the jar impact will be delivered to the well pipe string stuck portion.

In the eight inch example given, surface 47 and member 43 and surface 48 and member 45 are each initially at least, and preferably greater than 4 inches apart so that when 47 and 48 are in positions 47', 48 they are each more than eight inches from their respective members 43 and 45.

Similarly, surfaces 49 and 50 are each initially a minimum of f/2 or more than four inches from their respective members 44 and 46 and thus are more than eight inches (or "f" distance) from their members 44 and 46 when members 49 and 50 are in positions 49', 50', respectively.

Heretofore, in prior art devices no provision has been made for assuring that there is a free stroke, that is a minimum predetermined length of unrestrained, free relative longitudinal movement between the energy accumulator inner and outer members before initiating a load stroke in response to tensile loading of an upward jarring mechanism. In the present invention not only are there means for forming a free stroke in an energy accumulator that is a minimum predetermined length of unrestrained, free relative longitudinal movement between the inner and outer accumulator members in response to a tensile load, but also in response to a compressive load on the well pipe string so that the jarring impact is assured of delivery to the well pipe stuck portion and not to the well string above the jar, nor is the jar impact dissipated in the accelerator. The minimum predetermined length of unrestrained, free relative longitudinal movement between the inner and outer members is always greater than the unrestrained, free relative longitudinal movement between the jar mechanism members which effect engagement of the jarring surfaces to deliver a jarring impact.

The foregoing is accomplished even though variable tensile or compressive loads may be applied to the well string S, and the foregoing is accomplished also independently of the load rate variations that may occur when a compressible fluid such as nitrogen or silicone liquid is employed in lieu of the mechanical means. Where mechanical spring means is employed, higher temperature and pressure in the well bore may decrease the load rate so that while the free travel distance of the accelerator may be increased, far less effective energy is built up in the accelerator so as to render the accelerator less effective.

The foregoing also provides a means for accumulating energy within the accumulator arrangement upon restrained, relative longitudinal movement between the energy accumulator members in response to the compressive load on the well pipe string or in response to a tensile load on the well pipe string which accumulated energy is released by the jar mechanism to assist the jar mechanism in delivering either a downward or upward jarring impact to the well pipe string stuck portion as desired.

It can be understood that the means for forming the predetermined length of unrestrained, free relative longitudinal movement between the energy accumulator inner and outer members in response to the tensile load or compressive load on the well pipe string may be formed in any suitable manner to assure that such predetermined length of unrestrained, free relative longitudinal movement between the energy accumulator members is at a minimum greater than the length of unrestrained, free relative longitudinal movement between the inner and outer members of an up and down jar mechanism.

From the foregoing, it is seen that the inner and outer members of the energy accumulator are constructed and arranged to assure that the jarring impact of the jar mechanism is delivered to the stuck portion. Also, it assures that the double acting up or down arrangement in a single tool body does not interfere with assuring that the jar mechanism jarring surfaces will impact prior to the accelerator surfaces or prior to iterference by the accelerator.

FIGS. 6, 7, 8, 9 and 10 illustrate two alternate embodiments of the double acting accelerator of the invention which may be employed wherein like numerals are employed to identify the same component as shown in FIGS. 3 and 4. The same spacial relationship is present in these additional embodiment as is present in FIGS. 3 and 4, but in a slightly different manner and arrangement since compressible medium means, and not mechanical spring means are employed.

The well string S is connected with the inner member I of the energy accumulator E for movement longitudinally relative to the outer member O. If desired, the drive means can be exposed to the well bore B by providing ports and eliminating the lubricating chamber L.

In lieu of employing mechanical spring means for accumulating energy within the energy accumulator E, the chambers 40*a* and 40*b* may be charged with suitable gas means such as nitrogen or the like. Suitable fill plugs 40*c* are provided for communicating the gas and charging each the first and second chamber 40*a*, *40b* through passage means 40*d* and 40*e* communicating respectively with chamber means 40*a* and 40*b*. The chambers 40*a* and 40*b* are formed between seal means 41', 42' and 43'.

Suitable piston means in each chamber 40*a*, 40*b* of various configurations may be employed, such as are illustrated in various prior U.S. patents wherein the piston is constructed to form a seal with a restricted bore to prevent the flow of fluid around the piston during the jarring stroke of the jar used with the accelerator. A suitable form of piston means is illustrated in the drawings, and a separate piston means 51, 51*a* is provided for each chamber 40*a* and 40*b* on the inner member I.

Figure 7:
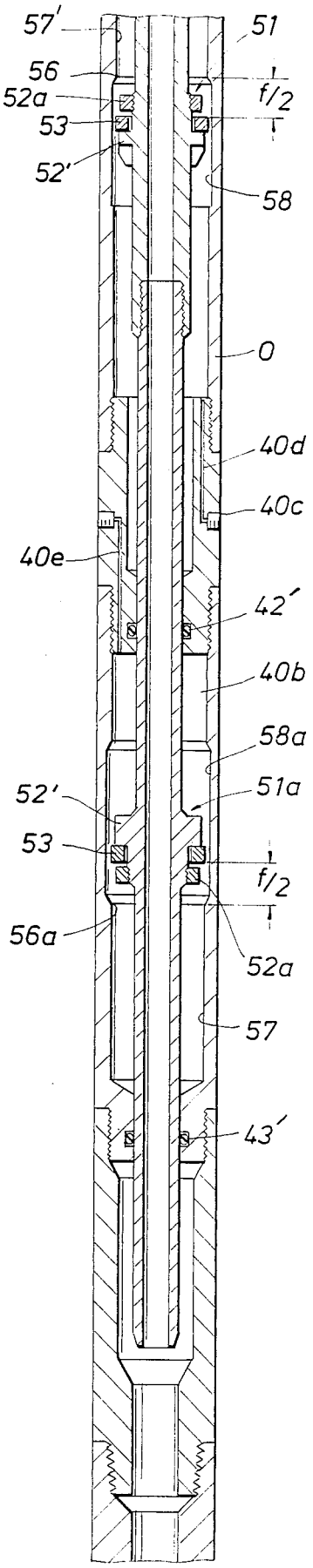

In FIG. 7, when the pistons 51, 51*a* are in the longitudinally extending enlarged diameter bore portions 58, 58*a* of the outer member O they will function to by-pass fluid therearound when the inner member I is moved in either an up or down direction. The piston ring 53 of piston 51 is supported on annular shoulder 52' as the piston 51 moves up. Free flow of gas around each of the pistons 51 and 51*a* in each of the chambers 40*a* and 40*b* can occur until the piston 51, in response to a tensile load in the well strings engages the piston ring 53 of piston 51 with the beginning 56 of reduced bore portion 57' of the outer member O so as to sealably move the seal ring 53 downwardly against annular member 52' to seal therewith to cut off flow through the fluid by-pass in the piston 51.

Similarly, when piston 51*a* is moved downwardly in enlarged bore 58*a* with the inner member I in response to a compressive load in the well string it will accommodate free flow therearound until its seal or piston ring 53 sealably engages the beginning 56*a* of reduced diameter portion 57 in the outer member O so that such seal ring seals therewith and is urged against the annular member 52' to seat thereon and close off flow therebetween. The piston ring 53 of piston 51*a* is retained on inner member I by annular surface 52*a* as the piston and inner member I move down.

The function of this device is the same as that described with regard to FIGS. 3 and 4.

The piston ring 53 is always a minimum f/2 predetermined length away from the adjacent edge 56 or edge 56*a* of the upper and lower restrictions 57', 57 as described between the surfaces 47 and member 43; surface 49 and member 44; surface 48 and member 45 and surface 50 and member 46 in FIGS. 3 and 4.

Similarly, the piston ring 53 and the other components of the piston means 51*a* are structured and arranged so that there is always a minimum predetermined length of unrestrained, free relative longitudinal movement between the piston ring 53 and the edge 56*a* of lower restriction 57 which is greater than f/2 as described with regard to the surfaces and members in FIGS. 3 and 4.

Thus, in response to a tensile load when the inner member I is pulled up, the piston 51 can move into longitudinal restricted upper bore 57' which terminates adjacent the upper end of enlarged bore 58. The distance before piston ring 53 seals with reduced upper bore 57' is a distance greater than one half of the unrestrained, free jar stroke and is represented by f/2. Since piston 51 is f/2 distance from sealing with restricted bore 57, piston 51*a* will move up f/2. The piston ring 53 of piston 51*a* is initially f/2 distance from edge 56*a* of lower restricted bore 57, and when moved up along with piston 51, it then is positioned a distance "f" which is greater than the unrestrained, free longitudinal movement between the jar mechanism members. Since there is always initially a minimum predetermined length between both pistons and their respective sealing edges 56 and 56*a* which is greater than one half the length of unrestrained, free relative longitudinal movement between the jar mechanism inner and outer members, the total length of minimum predetermined unrestrained, free relative longitudinal movement between the energy accumulator inner and outer members I and O in response to either a tensile load or a compressive load is always greater than the "f" length of unrestrained, free relative longitudinal movement between the members of the up and down jar mechanism.

As described with regard to the form illustrated in FIGS. 3 and 4, the same relationship and function occurs when a compressive load is applied.

Figure 8:
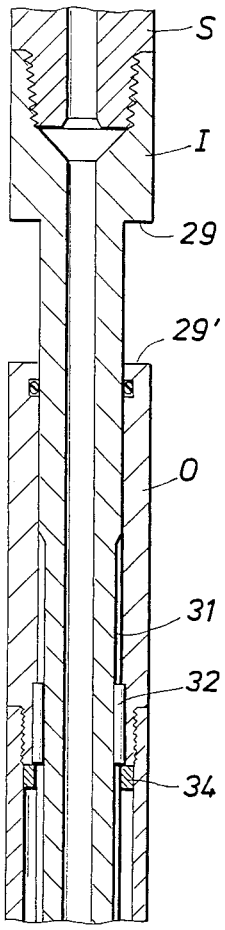
FIGS. 8 and 9 are sectional views which, when taken together, illustrate yet another embodiment of the present invention which may be employed with a compressible liquid such as silicone fluid.
Figure 9:
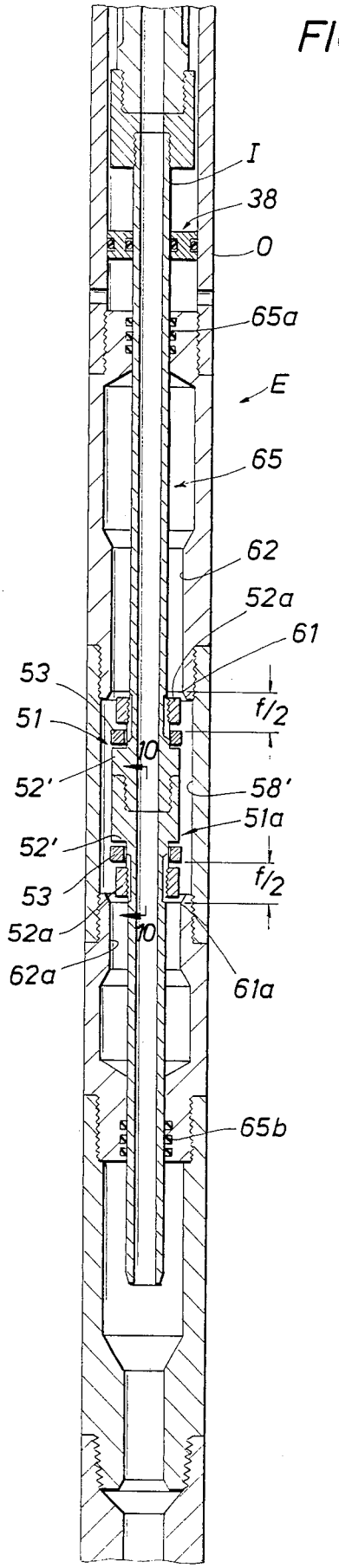
Figure 10:
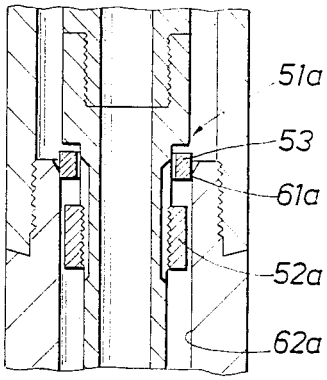
FIG. 10 is an enlarged view illustrating structural details of a piston means which may be employed to accumulate energy in the compressible medium in the energy accumulator.

FIGS. 8, 9 and 10 show a form of the invention which may be employed with a hydraulic or compressible medium such as silicone liquid. Like numbers apply to like components of FIGS. 6 and 7.

In this arrangement the piston means 51 and 51*a* are mounted in a single chamber referred to at 65 which extends longitudinally within the outer member O as illustrated between seals 65*a* and 65*b*. More specifically the piston means 51 and 51*a* are arranged within the same enlarged bore 58' formed in chamber 65 of the outer member O and the piston means 51, 51*a* are longitudinally spaced on inner member I relative to each other as shown in the drawings. Again, each piston can be positioned in the enlarged bore 58' so that the leading edge of the piston ring 53 of each piston 51 and 51*a* when on its respective shoulder 52', on each piston, is always greater than minimum f/2 predetermined length from the adjacent edge 61 an 61*a* with which the pistons 51, 51*a*, respectively, seal when either moves into its reduced bore 62, 62*a*, respectively, of the outer member. Such predetermined minimum length is greater than one half the length of unrestrained, free relative longitudinal movement between the one and other members of the up and down jar mechanism as indicated by f/2 in the drawings.

Thus, when the upper piston means 51 is moved upwardly in response to a tensile load toward the reduced bore 62 it will not seal therewith until it has travelled the predetermined minimum distance which is greater than one half the length of unrestrained, free relative longitudinal movement between the one and other members of the up and down jar mechanism. The piston ring 53 of piston 51*a* may at this time be resting on the annular member 52*a* and it too will travel upward in the enlarged bore 58' at least the same minimum amount that piston 51 does so that while it is initially spaced greater than one half the predetermined minimum distance or length of unrestrained, free relative longitudinal movement between the one and other members of the up and down jar mechanism, it will move yet another amount of at least the same extent. This then positions its seal ring 53 from the uppermost edge 61*a* of restricted bore 62*a* so that when a compressive load is applied to the inner member I, the seal ring 53 must move a minimum predetermined length which is greater than the length of unrestrained, free relative longitudinal movement between the one and other members of the up and down jar mechanism before its sealingly engages with the edge 61*a* of bore 62*a*.

The function of the above arrangement when a compressive load is applied is in the same manner as that described with regard to FIGS. 3, 4, 6 and 7.

Figure 11:
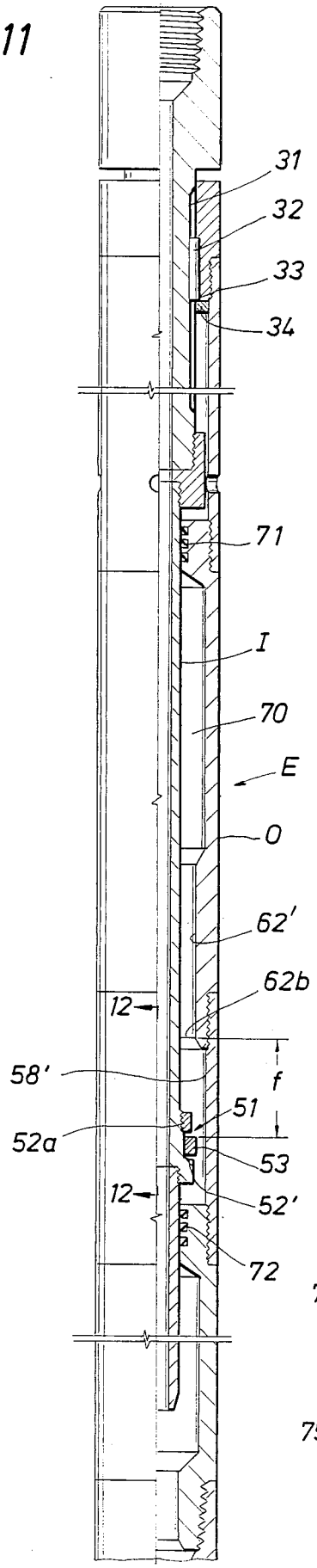
FIG. 11 is a quarter-sectional view illustrating an embodiment of a single up acting accelerator that employs the present invention which may be employed with a single up acting jar mechanism.

FIG. 11 illustrates an embodiment of the present invention where it is employed in a single acting up jar. Like numerals are indicated for like parts. The drive chamber in which members 31 are received in all forms of the invention may be open to the well bore or within a closed chamber.

A single piston means 51 is shown as being in an enlarged bore portion 58' of the chamber 70 formed between seals 71, 72 in outer member O, and such piston is generally constructed as that previously described. The chamber 70 is provided with suitable fill openings and plugs for receiving a compressible liquid or gas therein.

Figure 12:
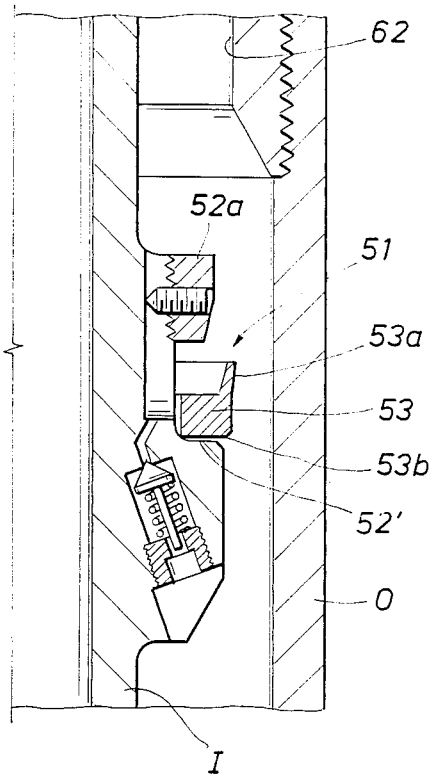
FIGS. 12 and 13 are enlarged sectional views illustrating a form of the piston means which may be employed with the present invention.

The piston ring 53 shown in detail in FIG. 12 may be used in lieu of the rectangular form shown in the other drawings. It will be noted that it is formed of non-ferrous metal such as a suitable bronze or the like for forming a sealing yet resilient seal with the restricted longitudinally extending bore portion 62 of the outer member O. As shown the piston ring 53 includes an outer annular tapered shoulder 53*a* of suitable configuration which projects or extends upwardly and flares outwardly from main annular body portion 53*b* so that when lip 53*a* engages with the restricted bore 62 it will sealingly engage therewith.

Figure 13:
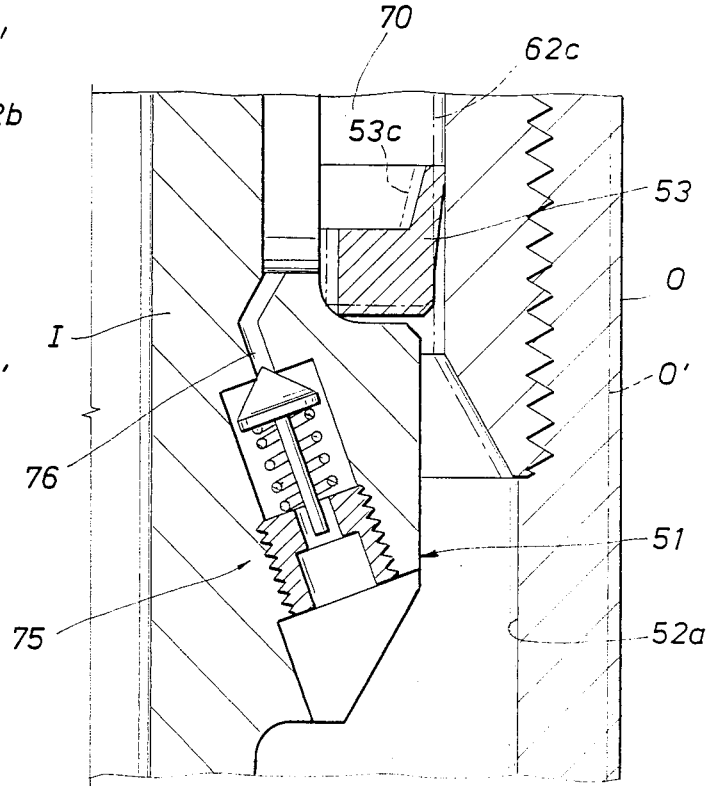

Well bore pressures may be substantial and exert a compressive force against the outer memeber O so that it may tend to collapse or move inwardly as represented at dotted line O' in FIG. 13. In such event, the lip 53*a* will accommodate such inward movement and still maintain a sealing relationship with the reduced internal bore represented at 62*c* by moving inwardly to the position represented by the dotted line at 53*c*. This may enable the piston 51 to maintain its sealing relationship while moving inwardly radially to accommodate the contraction of the adjacent outer wall in response to pressure while avoiding galling or binding of the piston that might otherwise render the accumulator inoperative.

If desired, the same form of piston ring and piston construction could be employed with the form of invention shown in FIGS. 6, 7, 8 and 9.

Under some circumstances the pressure build up in the chamber portion 70 may become excessive so that it approaches either the collapse pressure of the internal tubular member I, or the burst pressure of the external outer member O. In this event a suitable pressure relief valve 75 may be mounted in the inner member and communicate with the chamber portion 70 above where the piston 51 is sealingly engaged with restricted bore 62 by means of the passage 76 so that such valve will open at a predetermined pressure less than the burst or collapse pressure of the outer or inner members and conduct such pressure to the enlarged bore portion 52*a* beneath the piston ring 53.

In the FIG. 11 form, since it is a single acting energy accumulator, the distance from the piston ring's leading edge, that is, the edge which is nearest to the beginning 62*b* of the restricted bore 62' is at least the "f" distance which is the minimum predetermined unrestrained, free relative longitudinal movement between the jar mechanism members to engage the jar mechanism members jarring surfaces. The distance from the leading edge of the piston ring 53 to the beginning of the restricted bore is preferably somewhat greater than the "f" distance, as in the other embodiments.

From the foregoing, it is seen that in a single acting jar the "f" distance is initially present. The double acting jar, which in the embodiments shown, has only f/2 distance initially. In actual use and operation of the double acting jar where an up jar is to be first applied to the stuck object or "fish" after engagement therewith, the well string may be slacked off to develop the "f" distance in the free stroke of the accelerator in response to a subsequent tensile load, or pull on the well string. If a down jar is to be then next applied after the up jar, the "f" minimum distance in the accelerator will have been developed for the down jar motion during the preceding up jar motion.

Thus, this invention assures that the jar impact surfaces will impact on an up jar motion so that the drill collars, or hammer 30 is propelled upwardly to deliver a jarring blow to the stuck portion 24, and not the well string. Similarly, on a down jar motion, the jar surfaces impact and propel the hammer 30 downwardly to deliver a jarring blow to the stuck portion 24. The surfaces 29' and 29 in the accelerator are not engaged by the upward movement of the hammer 30 on an up jar and the end surfaces EW and on the position P in the accelerator E are not engaged by the downward movement of the hammer 30 during a down jar.

The foregoing disclosure and description of the invention are illustrative and explanatory thereof, and various changes in size, shape and materials as well as in the details of the illustrated construction may be made without departing from the spirit of the invention.

What is claimed is:

1. An accelerator for use with a jar mechanism in a well pipe string to enhance the jarring impact delivered to a stuck object wherein the jar mechanism includes inner and outer members for connection, respectively, between the well pipe string and the stuck object, the jar mechanism members being constructed to (1) restrict relative longitudinal movement therebetween to build up energy in the well pipe string and accelerator and then (2) to release the jar mechanism members for unrestrained, free relative longitudinal movement therebetween to engage jarring surfaces on the jar mechanism members for delivering a jarring impact to the stuck object, the accelerator including:

inner and outer telescopically connected members relatively movable longitudinally to accumulate energy in the accelerator;

said inner and outer accelerator members each having means for connecting the accelerator in the well pipe string;

means associated with said inner and outer members for initially acommodating a predetermined minimum length of unrestrained, free relative longitudinal movement between said inner and outer accelerator members;

means associated with said inner and outer accelerator members operable when said inner and outer accelerator members move relatively said predetermined minimum unrestrained length to restrain said inner and outer accelerator members against further unrestrained relative longitudinal movement and thereby accumulate energy in the accelerator; and said predetermined minimum length of unrestrained, free relative longitudinal movement of said inner and outer accelerator members being greater than the length of unrestrained, free relative longitudinal movement between the inner and outer members of the jar mechanism to assist in delivering a jarring impact to the stuck object.

2. An accelerator for use with a jar mechanism in a well pipe string to enhance a downward jarring impact delivered to a stuck object wherein the jar mechanism includes inner and outer members for connection, respectively, between the well pipe string and the stuck object, the jar mechanism members being constructed to (1) restrict relative longitudinal movement therebetween to build up energy in the well pipe string and accelerator and then (2) to release one of the jar mechanism members for unrestrained, free downward longitudinal movement relative to the other member to engage downward jarring surfaces on the jar mechanism members for delivering the downward jarring impact to the stuck object, the accelerator including:

inner and outer telescopically connected members relatively movable longitudinally to accumulate energy in the accelerator;

said inner and outer accelerator members having means for connecting the accelerator in the well pipe string;

means associated with said inner and outer members for initially accommodating a predetermined minimum length of unrestrained, free relative longitudinal movement between said inner and outer accelerator members;

means associated with said inner and outer accelerator members operable when said inner and outer accelerator members move relatively said predetermined minimum unrestrained length to restrain said inner and outer accelerator members against further unrestrained relative longitudinal movement and thereby accumulate energy in the accelerator; and said predetermined minimum length of unrestrained, free relative longitudinal movement of said inner and outer accelerator members being greater than the length of unrestrained, free relative longitudinal movement between the inner and outer members of the jar mechanism to deliver a downward jarring impact to the stuck object independently of the load rate of the accelerator.

3. An accelerator for use with a jar mechanism in a well pipe string to enhance a downward jarring impact delivered to a stuck object wherein the jar mechanism includes inner and outer members for connection, respectively, between the well pipe string and the stuck object, the jar mechanism members being constructed to (1) restrict relative longitudinal movement therebetween to build up energy in the well pipe string and accelerator and then (2) to release one of the jar mechanism members for unrestrained, free downward longitudinal movement relative to the other member to engage downward jarring surfaces on the jar mechanism members for delivering the downward jarring impact to the stuck object, the accelerator including:

inner and outer telescopically connected members relatively movable longitudinally to accumulate energy in the accelerator;

longitudinally spaced seal means between said inner and outer accelerator members forming chamber means between said inner and outer accelerator members;

means to initially accommodate a minimum predetermined length of unrestrained, free relative longitudinal movement between said inner and outer accelerator members;

means operable when said inner and outer accelerator members move relatively said minimum predetermined length to thereupon restrain said inner and outer accelerator members against further free relative longitudinal movement and thereby accumulate energy in the chamber means of said accelerator; and said minimum predetermined length of unrestrained, free relative longitudinal movement between said inner and outer accelerator members being greater than the length of unrestrained, free relative longitudinal movement between the inner and outer members of the jar mechanism.

4. An accelerator for use with a jar mechanism in a well pipe string to enhance the jarring impact delivered to a stuck object wherein the jar mechanism includes inner and outer members for connection, respectively, between the well pipe string and the stuck object, the jar mechanism members being constructed to (1) restrict relative longitudinal movement therebetween to build up energy in the well pipe string and accelerator and then (2) to release the jar mechanism members for unrestrained, free relative longitudinal movement therebetween to engage jarring surfaces on the jar mechanism members for delivering a jarring impact to the stuck object, the accelerator including:

inner and outer telescopically connected members relatively movable longitudinally to accumulate energy in the accelerator;

longitudinally spaced seal means between said inner and outer accelerator members forming chamber means between said inner and outer accelerator members;

means associated with said inner and outer accelerator members to initially accommodate a minimum predetermined length of unrestrained, free relative longitudinal movement between said inner and outer accelerator members;

means associated with said inner and outer accelerator members operable when said inner and outer accelerator members move relatively said minimum predetermined length to thereupon restrain said said inner and outer accelerator members against further free relative longitudinal movement and thereby accumulate energy in the chamber means of the accelerator; and said minimum predetermined length of unrestrained, free relative longitudinal movement between said inner and outer accelerator members being greater than the length of unrestrained, free relative longitudinal movement between the inner and outer members of the jar mechanism.

5. An accelerator for use with a jar mechanism in a well pipe string to enhance the jarring impact delivered to a stuck object wherein the jar mechanism includes inner and outer members for connection, respectively, between the well pipe string and the stuck object, the jar mechanism members being constructed to (1) restrict relative longitudinal movement therebetween to build up energy in the well pipe string and accelerator and then (2) to release the jar mechanism members for unrestrained, free relative longitudinal movement therebetween to engage jarring surfaces on the jar mechanism members for delivering a jarring impact to the stuck object, the accelerator including:

inner and outer telescopically connected members relatively movable longitudinally to accumulate energy in the accelerator;

said inner and outer accelerator members having means for connecting the accelerator in the well pipe string;

longitudinally spaced seal means between said inner and outer accelerator members forming chamber means between said inner and outer accelerator members;

spaced seal means between said inner and outer accelerator members forming lubricating chamber means for receiving lubricating fluid;

at least one of said lubricating chamber seal means being movable longitudinally while sealably engaging between said inner and outer accelerator members;

said outer accelerator member having passage means for communicating well bore pressure to act on said lubricating chamber movable seal means and equalize pressure in said lubricating chamber means with well bore pressure;

drive means in said lubricating chamber means for connecting said inner and outer accelerator members to prevent relative rotation therebetween, while accommodating relative longitudinal movement therebetween;

energy accumulation means for accumulating energy within the chamber means;

said energy accumulation means comprising:

means for accommodating a minimum predetermined length of unrestrained, free relative longitudinal movement between said inner and outer accelerator members;

means operable when said inner and outer accelerator members move relatively said minimum unrestrained predetermined length to restrain said inner and outer accelerator members against further unrestrained, free relative longitudinal movement;

said minimum predetermined length of unrestained, free relative longitudinal movement between said inner and outer accelerator members being greater than the length of unrestrained, free relative longitudinal movement between the inner and outer members of the jar mechanism.

6. The accelerator of claim 5 wherein said means to accommodate unrestrained, free relative longitudinal movement between said inner and outer accelerator members includes longitudinally spaced surface means on said inner and outer accelerator members in said chamber means and wherein said means operable to restrain said inner and outer accelerator members against further unrestrained, free relative longitudinal movement includes spring means in said chamber means and cooperating surface means between said inner and outer accelerator members for loading said spring means in response to a load on the well pipe string.

7. The accelerator of claim 6 wherein said spring means is mechanical means.

8. The accelerator of claim 6 wherein said spring means is gas means.

9. The accelerator of claim 6 wherein said spring means is hydraulic means.

10. An accelerator for use with a jar mechanism in a well pipe string to enhance the jarring impact delivered to a stuck object wherein the jar mechanism includes inner and outer members for connection, respectively, between the well pipe string and the stuck object, the jar mechanism members being constructed to (1) restrict relative longitudinal movement therebetween to build up energy in the well pipe string and accelerator and then (2) to release the jar mechanism members for unrestrained, free relative longitudinal movement therebetween to engage jarring surfaces on the jar mechanism members for delivering a jarring impact to the stuck object, the accelerator including:

inner and outer telescopically connected members relatively movable longitudinally to accumulate energy in the accelerator;

said inner and outer accelerator members having means for connecting the accelerator in the well pipe string;

longitudinally spaced seal means between said inner and outer accelerator members forming at least two chamber means between said inner and outer accelerator members;

spaced seal means between said inner and outer accelerator members forming lubricating chamber means for receiving lubricating fluids;

at least one of said lubricating chamber seal means being movable longitudinally while sealably engaging between said inner and outer accelerator members;

said outer accelerator member having passage means for communicating well bore pressure to act on said movable seal means and equalize pressure in said lubricating chamber means with well bore pressure;

drive means in said lubricating chamber means for connecting said inner and outer accelerator members to prevent relative rotation therebetween, while accommodating relative longitudinal movement therebetween;

energy accumulation means for accumulating energy in each of said at least two chambers;

said energy accumulation means comprising:

means for initially accommodating a minimum predetermined length of unrestrained, free relative longitudinal movement between said inner and outer accelerator members;

means operable when said inner and outer accelerator members move relatively said minimum unrestrained predetermined length to restrain said inner and outer accelerator members against further unrestrained, free relative longitudinal movement and thereby accumulate energy in each of at least two additional chambers of the accelerator; and said minimum predetermined length of unrestrained, free relative longitudinal movement between said inner and outer accelerator members being greater than the length of unrestrained, free relative longitudinal movement between the inner and outer members of the jar mechanism.

11. The accelerator of claim 10 wherein said means to initially accommodate unrestrained, free relative longitudinal movement between said inner and outer accelerator members includes longitudinally spaced surface means on said inner and outer accelerator members in each of said at least two chambers; and wherein said means operable to restrain said inner and outer accelerator members against further unrestrained, free relative longitudinal movement includes spring means in each of said at least two chambers and cooperating surface means between said inner and outer accelerator members for loading said spring means in response to a load on the well pipe string.

12. The accelerator of claim 11 wherein said spring means is mechanical means.

13. The accelerator of claim 11 wherein said spring means is gas means.

14. The accelerator of claim 11 wherein said spring means is hydraulic means.

15. An accelerator for use with a jar mechanism in a well pipe string to enhance an upward jarring impact delivered to a stuck object wherein the jar mechanism includes inner and outer members for connection, respectively, between the well pipe string and the stuck object, the jar mechanism members being constructed to (1) restrict relative longitudinal movement therebetween to build up energy in the well pipe string and accelerator and then (2) to release one of the jar mechanism members for unrestrained, free upward longitudinal movement relative to the other member to engage upward jarring surfaces on the jar mechanism members for delivering the upward jarring impact to the stuck object, the accelerator including:

inner and outer telescopically connected members relatively movable longitudinally to accumulate energy in the accelerator;

said inner and outer accelerator members having means for connecting the accelerator in the well pipe string;

means associated with said inner and outer members for initially accommodating a predetermined minimum length of unrestrained, free relative longitudinal movement between said inner and outer accelerator members;

means associated with said inner and outer accelerator members operable when said inner and outer accelerator members move relatively said predetermined minimum unrestrained length to restrain said inner and outer accelerator members against further unrestrained relative longitudinal movement and thereby accumulate energy in the accelerator; and said predetermined minimum length of unrestrained, free relative longitudinal movement of said inner and outer accelerator members being greater than the length of unrestrained, free relative longitudinal movement between the inner and outer members of the jar mechanism to deliver a jarring impact to the stuck object independently of the load rate of the accelerator.

16. The accelerator of claim 3 including drive means for connecting said inner and outer accelerator members to prevent relative rotation therebetween while accommodating relative longitudinal movement therebetween.

17. The accelerator of claim 3 wherein said means to accommodate unrestrained, free relative longitudinal movement between said inner and outer accelerator members includes longitudinally spaced surface means on said inner and outer accelerator members in said chamber means and wherein said means operable to restrain said inner and outer accelerator members against further unrestrained, free relative longitudinal movement includes spring means in said chamber means and cooperating surface means between said inner and outer energy accumulator members for loading said spring means in response to a load on the well pipe string.

18. An accelerator for use with a jar mechanism in a well pipe string to enhance an upward jarring impact delivered to a stuck object wherein the jar mechanism includes inner and outer members for connection, respectively, between the well pipe string and the stuck object, the jar mechanism members being constructed to (1) restrict relative longitudinal movement therebetween to build up energy in the well pipe string and accelerator and then (2) to release one of the jar mechanism members for unrestrained, free upward longitudinal movement relative to the other member to engage upward jarring surfaces on the jar mechanism members for delivering the upward jarring impact to the stuck object, the accelerator including:

inner and outer telescopically connected members relatively movable longitudinally to accumulate energy in the accelerator;

longitudinally spaced seal means between said inner and outer accelerator members forming chamber means between said inner and outer accelerator members;

means to initially accommodate a minimum predetermined length of unrestrained, free relative longitudinal movement between said inner and outer accelerator members;

means operable when said inner and outer accelerator members move relatively said minimum predetermined length to thereupon restrain said inner and outer accelerator members against further free relative longitudinal movement and thereby accumulate energy in the chamber means of said accelerator; and said minimum predetermined length of unrestrained, free relative longitudinal movement between said inner and outer accelerator members being greater than the length of unrestrained, free relative longitudinal movement between the inner and outer members of the jar mechanism.

19. An accelerator for use with a jar mechanism in a well pipe string to enhance an upward jarring impact delivered to a stuck object wherein the jar mechanism includes inner and outer members for connection, respectively, between the well pipe string and the stuck object, the jar mechanism members being constructed to (1) restrict relative longitudinal movement therebetween to build up energy in the well pipe string and accelerator and then (2) to release one of the jar mechanism members for unrestrained, free upward longitudinal movement relative to the other member to engage upward jarring surfaces on the jar mechanism members for delivering the upward jarring impact to the stuck object, the accelerator including:

inner and outer telescopically connected members relatively movable longitudinally to accumulate energy in the accelerator;

said inner and outer accelerator members having means for connecting the accelerator in the well pipe string;

longitudinally spaced seal means between said members forming chamber means between said inner and outer members;

spaced seal means between said inner and outer accumulator members forming lubricating chamber means for receiving lubricating fluids;

at least one of said lubricating chamber seal means being movable longitudinally while sealably engaging between said inner and outer accelerator members;

said outer accelerator member having passage means for communicating well bore pressure to act on said movable seal means and equalize pressure in said lubricating chamber means with well bore pressure;

drive means in said lubricating chamber means for connecting said inner and outer accelerator members to prevent relative rotation therebetween, while accommodating relative longitudinal movement therebetween;

additional spaced seal means between said energy accumulator members forming additional chamber means therebetween;

energy accumulation means for accumulating energy within the additional chamber means in response to a tensile load applied to the well pipe string;

said energy accumulation means comprising:

means for initially accommodating a minimum predetermined length of unrestrained, free relative longitudinal movement between said inner and outer accelerator members in response to a tensile load applied to the well pipe string;

means operable in response to a tensile load applied to the well pipe string when said inner and outer accelerator members move relatively said minimum predetermined length to restrain said inner and outer accelerator members against further unrestrained, free relative longitudinal movement and thereby accumulate energy in the additional chamber means of the accelerator; and said minimum predetermined length of unrestrained, free relative longitudinal movement between said inner and outer accelerator members being greater than the length of unrestrained, free relative longitudinal movement between the inner and outer members of the jar mechanism.

20. The accelerator of claim 18 wherein said means to accommodate unrestrained, free relative longitudinal movement between said inner and outer accelerator members includes longitudinally spaced surface means on said inner and outer accelerator members in said chamber means and wherein said means operable to restrain said inner and outer accelerator members against further unrestrained, free relative longitudinal movement includes spring means in said chamber means and cooperating surface means between said inner and outer energy accumulator members for loading said spring means in response to a load on the well pipe string.

21. The accelerator of claim 20 wherein said spring means is mechanical means.

22. The accelerator of claim 20 wherein said spring means is gas means.

23. The accelerator of claim 20 wherein said spring means is hydraulic means.

24. An accelerator for use with a jar mechanism in a well pipe string to enhance an upward jarring impact delivered to a stuck object wherein the jar mechanism includes inner and outer members for connection, respectively, between the well pipe string and the stuck object, the jar mechanism members being constructed to (1) restrict relative longitudinal movement therebetween to build up energy in the well pipe string and accelerator and then (2) to release one of the jar mechanism members for unrestrained,, free upward longitudinal movement relative to the other member to engage upward jarring surfaces on the jar mechanism members for delivering the upward jarring impact to the stuck object, the accelerator including:

inner and outer telescopically connected members relatively movable longitudinally to accumulate energy in the accelerator;

said inner and outer accelerator members having means for connecting the accelerator in the well pipe string;

longitudinally spaced seal means between said inner and outer accelerator members forming chamber means between said inner and outer accelerator members;

spaced seal means between said inner and outer accelerator members forming lubricating chamber means for receiving lubricating fluid;

at least one of said lubricating chamber seal means being movable longitudinally while sealably engaging between said members;

said outer accelerator member having passage means for communicating well bore pressure to act on said movable seal means and equalize pressure in said lubricating chamber means with well bore pressure;

drive means for connecting said inner and outer accelerator members to prevent relative rotation therebetween, while accommodating relative longitudinal movement therebetween;

additional spaced seal means between said inner and outer accelerator members forming additional chamber means therebetween, said additional chamber means comprising at least two chambers;

energy accumulation means for accumulating energy in each of said at least two chambers in response to a tensile load applied to the well pipe string;

said energy accumulation means comprising:

means for initially accommodating a minimum predetermined length of unrestrained, free relative longitudinal movement between said inner and outer accelerator members in response to a tensile load applied to the well pipe string;

means operable in response to a tensile load applied to the well pipe string when said inner and outer accelerator members move relatively said minimum predetermined length to restrain said inner and outer accelerator members against further unrestrained, free relative longitudinal movement and thereby accumulate energy in each of the two additional chambers of the accelerator; and said minimum predetermined length of unrestrained, free relative longitudinal movement between said inner and outer accelerator members being greater than the length of unrestrained, free relative longitudinal movement between the inner and outer members of the jar mechanism.

25. The accelerator of claim 24 wherein said means to initially accommodate unrestrained, free relative longitudinal movement between said inner and outer accelerator members includes longitudinally spaced surface means on said inner and outer accelerator members in each of said two chambers; and wherein said means operable in response to a tensile load applied to the well pipe string to restrain inner and outer accelerator accumulator members against further, unrestrained free relative longitudinal movement includes spring means in each of said two chambers and cooperating surface means between said inner and outer accelerator members for loading said spring means in response to a load on the well pipe string.

26. The accelerator of claim 25 wherein said spring means is mechanical means.

27. The accelerator of claim 25 wherein said spring means is gas means.

28. The accelerator of claim 25 wherein said spring means is hydraulic means.

29. The accelerator of claim 17 wherein said spring means is mechanical means.

30. The accelerator of claim 17 wherein said spring means is gas means.

31. The accelerator of claim 17 wherein said spring means is hydraulic means.

32. An accelerator for use with a jar mechanism in a well pipe string to enhance the up and/or down jarring impact delivered to a stuck object in a well bore wherein the jar mechanism includes inner and outer members for connection, respectively, between the well pipe string and the stuck object, the jar mechanism members being constructed to (1) restrict relative longitudinal movement therebetween to selectively build up tensile or compressive energy in the well pipe string and accelerator for delivering an up and/or a down jarring impact to the well pipe stuck portion and then (2) to release the jar mechanism members for unrestrained, free relative longituinal movement therebetween to engage jarring surfaces on the jar mechanism members and deliver the desired up and/or down jarring impact to the stuck object, the accelerator including:

inner and outer telescopically connected members relatively movable to accumulate energy in the accelerator to assist the jar mechanism in delivering an up and/or down jarring impact to the stuck object;

said inner and outer accelerator members having means for connecting the accelerator in the well pipe string;

longitudinally spaced seal means between said inner and outer accelerator means forming chamber means between said inner and outer accelerator members;

means associated with said inner and outer accelerator members for accumulating energy within the accelerator upon restricted, relative longitudinal movement between said inner and outer accelerator members in response to a tensile load on the well pipe string, which accumulated energy is released by the jar mechanism to assist the jar mechanism in delivering an upward jarring impact to the stuck object;

means associated with the accelerator inner and outer members for accumulating energy within the accelerator upon restricted, relative longitudinal movement between said inner and outer accelerator members in response to a compressive load on the well pipe string, which accumulated energy is released by the jar mechanism to assist the jar mechanism in delivering a downward jarring impact to the stuck object;

means for accommodating a minimum predetermined length of unrestrained, free relative longitudinal movement between said inner and outer accelerator members in response to the tensile load or compressive load on the well pipe string; and said minimum predetermined length of unrestrained, free relative longitudinal movement between said inner and outer accelerator members being greater than the length of unrestrained, free relative longitudinal movement between the inner and outer members of the up and down jar mechanism.

33. A mechanical spring means energy accumulator for use with a jar mechanism in a well pipe string to enhance the up and/or down jarring impact delivered to a stuck object wherein the jar mechanism includes inner and outer members for connection, respectively, between the well pipe string and the stuck object, the jar mechanism members being constructed to (1) restrict relative longitudinal movement therebetween to selectively build up tensile or compressive energy in the well pipe string and accelerator for delivering an up and/or a down jarring impact to the well pipe stuck portion and then (2) to release the jar mechanism members for unrestrained, free relative longitudinal movement therebetween to engage jarring surfaces on the jar mechanism members and deliver the desired up and/or down jarring impact to the stuck object, the energy accumulator including:

inner and outer telescopically connected members relatively movable to accumulate energy in the energy accumulator to assist the jar mechanism in delivering an up and/or down jarring impact to the well pipe string stuck portion;

the energy accumulator inner and outer members having means for connection with the well pipe string;

longitudinally spaced seal means between said inner and outer energy accumulator members forming first and second chamber means between said energy accumulator members;

spaced seal means between said energy accumulator members forming lubricating chamber means for receiving lubricating fluid;

at least one of said lubricating chamber seal means being movable longitudinally while sealably engaging between said energy accumulator members;

said outer energy accumulator member having passage means for communicating well bore pressure to act on said movable seal means and equalize pressure in said lubricating chamber means with well bore pressure;

drive means in said lubricating chamber means for connecting said inner and outer energy accumulator members to prevent relative rotation therebetween, while accommodating relative longitudinal movement therebetween;

energy accumulation means for accumulating energy within the first and second chamber means;

said energy accumulation means comprising:

mechanical spring means for accumulating energy within the first chamber means upon restrained, relative longitudinal movement between said energy accumulator members in response to a tensile load on the well pipe string, which accumulated energy is released by the jar mechanism to assist the jar mechanism in delivering an upward jarring impact to the stuck object;

mechanical spring means for accumulating energy within the second chamber means upon restrained, relative longitudinal movement between said energy accumulator members in response to a compressive load on the well pipe string, which accumulated energy is released by the jar mechanism to assist the jar mechanism in delivering a downward jarring impact to the stuck object;

means for accommodating a minimum predetermined length of unrestrained, free relative longitudinal movement between said energy accumulator inner and outer members in response to the tensile load or compressive load on the well pipe string; and said minimum predetermined length of unrestrained, free relative longitudinal movement between said energy accumulator members being greater than the length of unrestrained, free relative longitudinal movement between the inner and outer members of the up and down jar mechanism.

34. A gas means energy accumulator for use with a jar mechanism in a well pipe string to enhance the up and/or down jarring impact delivered to a stuck object wherein the jar mechanism includes inner and outer members for connection, respectively, between the well pipe string and the stuck object , the jar mechanism members being constructed to (1) restrict relative longitudinal movement therebetween to selectively build up tensile or compressive energy in the well pipe string and accelerator for delivering an up and/or a down jarring impact to the well pipe stuck portion and then (2) to release the jar mechanism members for unrestrained, free relative longitudinal movement therebetween to engage jarring surfaces on the jar mechanism members and deliver the desired up and/or down jarring impact to the stuck object, the energy accumulator including:

inner and outer telescopically connected members relatively movable to accumulate energy in said energy accumulator to assist the jar mechanism in delivering an up and/or down jarring impact to the stuck object;

said energy accumulator inner and outer members having means for connection with the well pipe string;

longitudinally spaced seal means between said energy accumulator inner and outer members forming first and second chamber means between said energy accumulator inner and outer members;

spaced seal means between said energy accumulator members forming lubricating chamber means for receiving lubricating fluid;

at least one of said lubricating chamber seal means being movable longitudinally while sealably between said members;

said outer energy accumulator member having passage means for communicating well bore pressure to act on said movable seal means and equalize pressure in said lubricating chamber means with well bore pressure;

drive means in said lubricating chamber means for connecting said inner and outer members to prevent relative rotation therebetween, while accommodating relative longitudinal movement therebetween;

energy accumulation means for accumulating energy within the first chamber means;

said energy accumulation means comprising:

gas means for accumulating energy within the first chamber means upon restrained, relative longitudinal movement between said inner and outer energy accumulator members in response to a tensile load on the well pipe string, which accumulated energy is released by the jar mechanism to assist the jar mechanism in delivering an upward jarring impact to the stuck object;

gas means for accumulating energy within the second chamber means upon restrained, relative longitudinal movement between said inner and outer energy accumulator members in response to a compressive load on the well pipe string, which accumulated energy is released by the jar mechanism to assist the jar mechanism in delivering a downward jarring impact to the stuck object;

means for providing a minimum predetermined length of unrestrained, free relative longitudinal movement between said energy accumulator inner and outer members in response to the tensile load or compressive load on the well pipe string; and said minimum predetermined length of unrestrained, free relative longitudinal movement between said energy accumulator members being greater than the length of unrestrained, free relative longitudinal movement between the inner and outer members of the up and down jar mechanism.

35. A hydraulic means energy accumulator for use with a jar mechanism in a well pipe string to enhance the up and/or down jarring impact delivered to a stuck object wherein the jar mechanism includes inner and outer members for connection, respectively, between the well pipe string and the stuck object, the jar mechanism members being constructed to (1) restrict relative longitudinal movement therebetween to selectively build up tensile or compressive energy in the well pipe string and energy accumulator for delivering an up and/or a down jarring impact to the well pipe stuck portion and then (2) to release the jar mechanism members for unrestrained, free relative longitudinal movement therebetween to engage jarring surfaces on the jar mechanism members and deliver the desired up and/or down jarring impact to the stuck object, the energy accumulator including:

inner and outer telescopically connected members relatively movable to accumulate energy in said energy accumulator to assist the jar mechanism in delivering an up and/or down jarring impact to the stuck object;

said energy accumulator inner and outer members having means for connection with the well pipe string;

longitudinally spaced seal means between said energy accumulator members forming first and second chamber means between said energy accumulator members;

spaced seal means between said energy accumulator members forming lubricating chamber means for receiving lubricating fluid;

at least one of said lubricating chamber seal means being movable longitudinally while sealably engaging between said members;

said outer member having passage means for communicating well bore pressure to act on said movable seal means and equalize pressure in said lubricating chamber means with well bore pressure;

drive means in said lubricating chamber means for connecting said inner and outer energy accumulator members to prevent relative rotation, while accommodating relative longitudinal movement between said energy accumulator inner and outer members;

energy accumulation means for accumulating energy within said first chamber means;

said energy accumulation means comprising:

compressive liquid means for accumulating energy within said first chamber means upon restrained, relative longitudinal movement between said energy accumulator inner and outer members in response to a tensile load on the well pipe string, which accumulated energy is released by the jar mechanism to assist the jar mechanism in delivering an upward jarring impact to the stuck object;

compressive liquid means for accumulating energy within said second chamber means upon restrained, relative longitudinal movement between said energy accumulator inner and outer members in response to a compressive load on the well pipe string, which accumulated energy is released by the jar mechanism to assist the jar mechanism in delivering a downward jarring impact to the stuck object;

means for providing a minimum predetermined length of unrestrained, free relative longitudinal movement between said energy accumulator inner and outer members in response to the tensile load or compressive load on the well pipe string; and said minimum predetermined length of unrestrained, free relative longitudinal movement between said energy accumulator inner and outer members being greater than the length of unrestrained, free relative longitudinal movement between the inner and outer members of the up and down jar mechanism.

36. The energy accumulator of claim 33 wherein said means for providing a predetermined length of unrestrained, free relative longitudinal movement between said energy accumulator inner and outer members includes longitudinally spaced cooperating surface means on said inner and outer energy accumulator members in the first and second chamber means.

37. The energy accumulator of claims 34 or 35 wherein said means for providing a predetermined length of unrestrained, free relative longitudinal movement between said energy accumulator inner and outer members includes longitudinally spaced cooperating surface means on said inner and outer energy accumulator members in the first chamber means.

38. A mechanical spring means energy accumulator for use with a jar mechanism in a well pipe string to enhance the upward jarring impact delivered to a stuck object wherein the jar mechanism includes inner and outer members for connection, respectively, between the well pipe string and the stuck object, the jar mechanism members being constructed to (1) restrict relative longitudinal movement therebetween to build up energy in the well pipe string and energy accumulator for delivering an up jarring impact to the stuck object and then (2) to release the jar mechanism members for unrestrained, free relative longitudinal movement therebetween to engage jarring surfaces on the jar mechanism members and deliver the desired up jarring impact to the stuck object, the energy accumulator including:

inner and outer telescopically connected members relatively movable longitudinally to accumulate energy in said energy accumulator to assist the jar mechanism in delivering an up jarring impact to the stuck object;

longitudinally spaced seal means between said members forming chamber means between said energy accumulator members;

spaced seal means between said energy accumulator members forming lubricating chamber means for receiving lubricating fluid;

at least one of said lubricating chamber seal means being movable longitudinally while sealably engaging between said members;

said energy accumulator outer member having passage means for communicating well bore pressure to act on said movable seal means and equalize pressure in said lubricating chamber means with the well bore pressure;

drive means in said lubricating chamber means for connecting said inner and outer members to prevent relative rotation, while accommodating relative longitudinal movement between said energy accumulator inner and outer members;

mechanical spring means for accumulating enery within the chamber means in response to a tensile load applied to the well pipe string;

longitudinally spaced surfaces on said inner and outer energy accumulator members in said chamber means to initially accommodate a minimum predetermined length of unrestrained, free relative longitudinal movement between said energy accumulator members in response to a tensile load applied to the well pipe string;

said cooperating surface means operable in response to the tensile load applied to the well pipe string when said energy accumulator members move relative said minimum predetermined length to engage and compress said mechanical spring means for restraining said energy accumulator members against further unrestrained, free relative longitudinal movement and thereby accumulate energy in said spring means of said energy accumulator; and said minimum predetermined length of unrestrained free relative longitudinal movement between said energy accumulator members being greater than the length of unrestrained, free relative longitudinal movement between the inner and outer members of the up jar mechanism.

39. A gas means energy accumulator for use with a jar mechanism in a well pipe string to enhance the upward jarring impact delivered to a stuck object wherein the jar mechanism includes inner and outer members for connection, respectively, between the well pipe string and the stuck object, the jar mechanism members being constructed to (1) restrict relative longitudinal movement therebetween to build up energy in the well pipe string and energy accumulator for delivering an up jarring impact to the well pipe stuck portion and then (2) to release the jar mechanism members for unrestrained, free relative longitudinal movement therebetween to engage jarring surfaces on the jar mechanism members and deliver the desired up jarring impact to the stuck object, the energy accumulator including:

inner and outer telescopically connected members relatively movable longitudinally to accumulate energy in said energy accumulator to assist the jar mechanism in delivering an up jarring impact to the well pipe string stuck portion;

longitudinally spaced seal means between said members forming chamber means between said energy accumulator members;

spaced seal means between said energy accumulator members forming lubricating chamber means for receiving lubricating fluid;

at least one of said lubricating chamber means seal means being movable longitudinally while sealably engaging between said members;

said outer member having passage means for communicating well bore pressure to act on said movable seal means and equalize pressure in said lubricating chamber means with well bore pressure;

drive means in said lubricating chamber means for connecting said inner and outer members to prevent relative rotation, while accommodating relative longitudinal movement between said energy accumulator inner and outer members;

gas means for accumulating energy within said chamber means in response to a tensile load applied to the well pipe string;

a longitudinally extending larger inner diameter portion in said chamber means providing an enlarged bore in said outer member which extends from a smaller inner diameter portion which defines a bore of reduced diameter in said outer member and piston means on said inner member provided with piston ring means thereon of a smaller diameter than the enlarged bore to accommodate a minimum predetermined length of unrestrained, free relative longitudinal movement between said energy accumulator inner and outer members in response to a tensile load applied to the well pipe string;

said piston means and piston means ring thereon tightly fitting within said reduced bore diameter in response to a tensile load applied to the well pipe string when said energy accumulator members move relatively said minimum predetermined length to restrain said energy accumulaftor members against further unrestrained, free relative longitudinal movement and thereby accumulate energy in the gas means in the chamber means of said energy accumulator; and said minimum predetermined length of unrestrained, free relative longitudinal movement between said energy accumulator members being greater than the length of unrestrained, free relative longitudinal movement between the inner and outer members of the jar mechanism.

40. A compressible liquid energy accumulator for use with a jar mechanism in a well pipe string to enhance the upward jarring impact delivered a stuck object wherein the jar mechanism includes inner and outer members for connection, respectively, between the well pipe string and the stuck object, the jar mechanism members being constructed to (1) restrict relative longitudinal movement therebetween to build up energy in the well pipe string and energy accumulator for delivering an up jarring impact to the well pipe stuck portion and then (2) to release the jar mechanism members for unrestrained, free relative longitudinal movement therebetween to engage jarring surfaces on the jar mechanism members and deliver the desired up jarring impact to the stuck object, the energy accumulator including:

inner and outer telescopically connected members relatively movable longitudinally to accumulate energy in said energy accumulator to assist the jar mechanism in delivering an up jarring impact to the well pipe string stuck portion;

longitudinally spaced seal means between said members forming chamber means between said energy accumulator members;

spaced seal means between said energy accumulator members forming lubricating chamber means for receiving lubricating fluids;

at least one of said lubricating chamber seal means being movable longitudinally while sealably engaging between said members;

said outer member having passage means for communicating well bore pressure to act on said movable seal means and equalize pressure in said lubricating chamber means with well bore pressure;

drive means in said lubricating chamber means for connecting said inner and outer members to prevent relative rotation, while accommodating relative longitudinal movement between said energy accumulator inner and outer members;

compressible liquid means for accumulating energy within the chamber means in response to a tensile load applied to the well pipe string;

a longitudinally extending larger inner diameter portion in said chamber means providing an enlarged bore in said outer member which extends from a smaller inner diameter portion which defines a bore of reduced diameter in said outer member and piston means on said inner member provided with piston ring means thereon of a smaller diameter than the enlarged bore to accommodate a minimum predetermined length of unrestrained, free relative longitudinal movement between said energy accumulator inner and outer members in response to a tensile load applied to the well pipe string;

said piston means and piston means ring thereon tightly fitting within said reduced bore diameter in response to a tensile load applied to the well pipe string when said energy accumulator members move relatively said minimum predetermined length to restrain said energy accumulator members against further unrestrained, free relative longitudinal movment and thereby accumulate energy in the compressible liquid means in the chamber means of said energy accumulator; and said minimum predetermined length of unrestrained, free relative longitudinal movement between said energy accumulator members being greater than the length of unrestrained, free relative longitudinal movement between the inner and outer members of the jar mechanism.

41. The mechanical spring means energy accumulator of claim 33 wherein said means for forming a predetermined minimum length of unrestrained, free reltive longitudinal movement includes shoulder surface means on said inner member, support members supporting said mechanical spring means at each end, and shoulder support means on said outer member to limit the extent of longitudinal movement of said mechanical spring support members and said mechanical springs supported thereby to form spacial distances between said shoulder surface means and said mechanical spring support members upon relative longitudinal movement between said inner and outer members in response to tensile and/or compressive loading of the well string.

42. The energy accumulator of claims 34 or 35 wherein said means for accumulating energy includes pressure relief means to relieve accumulated energy in said chamber means to inhibit exceeding the collapse pressure of said inner member and the burst pressure of said outer member.

43. The energy accumulator of claims 39 or 40 including pressure relief means to relieve accumulated energy in said chamber means to inhibit exceeding the collapse pressure of said inner member and the burst pressure of said outer member and including means to maintain a sealing relationship between said piston ring and bore of reduced diameter without galling or binding by excess external well bore pressure acting on said outer member.

44. The energy accumulator of claim 32 wherein said means for accumulating energy is mechanical spring means.

45. The energy accumulator of claim 32 wherein said means for accumulating energy is gas means.

46. The energy accumulator of claim 32 wherein said means for accumulating energy is compressible liquid means.

47. The energy accumulator claims 39 or 40 including pressure relief means to relieve accumulated energy in said chamber means to inhibit exceeding the collapse pressure of said inner member and the burst pressure of said outer member in response to a tensile load on the well pipe string and wherein said outer accelerator member has a bore of reduced diameter and means to maintain a sealing relationship between said piston ring and said bore of reduced diameter without galling or binding by excess external well bore pressure acting on said outer member.

48. The accumulator of claim 34 including:

additional seal means between said energy accumulator members forming second chamber means therebetween; and wherein the gas means of said energy accumulation means accumulates energy within the first and second chamber means.

* * * * *